US005440301A

United States Patent [19]

Evans

[11] Patent Number: 5,440,301

[45] Date of Patent: Aug. 8, 1995

[54] INTELLIGENT ALERTING AND LOCATING COMMUNICATION SYSTEM

[76] Inventor: Wayne W. Evans, 1118 Calibre Creek Pkwy., Roswell, Ga. 30076

[21] Appl. No.: 173,889

[22] Filed: Dec. 27, 1993

Related U.S. Application Data

[63] Continuation of Ser. No. 21,514, Feb. 23, 1993, abandoned, which is a continuation of Ser. No. 606,073, Oct. 30, 1990, abandoned, which is a continuation-in-part of Ser. No. 523,112, May 14, 1990, abandoned.

[51] Int. Cl.[6] ..... G08B 1/08

[52] U.S. Cl. ..... 340/870.11; 340/825.06; 340/825.08; 340/825.10; 340/870.27; 340/870.41; 340/518; 340/521; 340/825.49

[58] Field of Search ..... 340/825.06-825.08, 340/825.1, 870.11, 870.13, 870.27, 870.41, 518, 521, 573, 870.28, 286.07, 825.49; 307/116, 125, 130; 128/903

[56] References Cited

U.S. PATENT DOCUMENTS

| | | | |
|---|---|---|---|
| 3,925,763 | 12/1975 | Wadhwani et al. | 340/164 R |
| 3,927,404 | 12/1975 | Cooper | 340/413 |
| 4,473,784 | 9/1984 | Morez | 318/439 |
| 4,517,555 | 5/1985 | Marsocci et al. | 340/522 |
| 4,535,401 | 8/1985 | Penn | 364/132 |
| 4,558,316 | 12/1985 | Yong | 340/825.06 |
| 4,562,428 | 12/1985 | Harman et al. | 340/552 |
| 4,622,541 | 11/1986 | Stockdale | 340/566 |
| 4,658,243 | 4/1987 | Kimura et al. | 340/825.07 |
| 4,668,939 | 5/1987 | Kimura et al. | 340/521 |
| 4,672,310 | 6/1987 | Sayed | 324/133 |
| 4,727,359 | 2/1988 | Yuchi et al. | 340/518 |
| 4,742,334 | 5/1988 | Teich et al. | 340/505 |
| 4,792,798 | 12/1988 | Wilowski | 340/696 |
| 4,831,558 | 5/1989 | Shoup et al. | 340/825.08 |
| 4,858,622 | 8/1989 | Osterweil | 340/573 |
| 4,999,607 | 3/1991 | Evans | 340/533 |

OTHER PUBLICATIONS

Harris-HD 15530-CMOS-Manchester Encoder-Decoder p. 5-3 through p. 5-9 no date available.

Supertex, Inc. Programmable Encoder/Decoder 51/5-8 no date available.

Digital Slave Communications-Sescoa-pp. 1-3 no date available.

*Primary Examiner*—Michael Horabik

*Attorney, Agent, or Firm*—Louis T. Isaf; Jeffrey R. Kuester

[57] ABSTRACT

An intelligent alerting and locating communication system includes a centrally located scanner which communicates with a plurality of remotely located receivers to continuously monitor conditions through a plurality of detectors associated with each receiver, including smoke detectors and motion detectors, and through personal radio transmitters. Each detector detects an off-normal state in a monitored condition and makes an indication that is sensed by at least one receiver which stores the occurrence in memory. Each radio frequency transmitter emits a unique coded signal which is received by one or more receivers. If the coded signal is in a valid format, the coded signal is stored in memory. If the coded signal matches a unique code assigned to that receiver, a matched code signal is generated and also stored in memory. The scanner polls each receiver for information stored in memory by sending out unique addresses onto a communication link connecting all receivers, and the appropriate receiver responds to the polling by sending condition information back to the scanner, including any code received from any transmitter so that every receiver which receives a transmitter code communicates that code to the scanner. A controller device is connected to the scanner device which receives address information from the scanner and condition information, including transmitter codes, from each receiver and processes that information and information from a related database to generate a graphical display of condition data, related database data, and location information derived from receiver addresses.

14 Claims, 21 Drawing Sheets

INTELLIGENT ALERTING AND LOCATING COMMUNICATION SYSTEM

CROSS-REFERENCE TO RELATED APPLICATION

This is a continuation of prior application Ser. No. 08/021,514, filed Feb. 23, 1993 now abandoned, which is a continuation of prior Ser. No. 07/606,073, filed Oct. 30, 1990 now abandoned, which is a continuation-in-part of prior application Ser. No. 07/523,112, filed May 14, 1990 now abandoned.

FIELD OF THE INVENTION

The present invention relates generally to the field of communication systems, and more specifically to the field of monitoring systems wherein each monitoring system monitors conditions in remote areas from a central location.

BACKGROUND OF THE INVENTION

There are many types of monitoring systems wherein each monitoring system monitors conditions in remote areas from a central location. The need for such systems is readily recognizable. A remote area, occasionally referred to as a zone or a sector, frequently corresponds to an apartment or a room wherein a condition is monitored. Smoke detectors and intrusion detectors are common types of detectors used to monitor conditions within remote areas. Various methods have been utilized to provide a central location with limited amounts of information corresponding to the monitored conditions.

Most monitoring systems which monitor conditions in remote areas from central locations have the ability to at least determine that some type of condition has changed from a normal state to an off-normal state somewhere within the monitored areas. One of the simplest methods for accomplishing this is a single current loop with detectors placed in a series electrical relationship with each other proceeding from the central location through each area and back to the central location. As long as current flows through a normally closed loop, or as long as no current flows in the alternate normally open loop, it is often assumed that no monitored condition has changed. It should be evident that this type of system has its limitations, including the inability to determine the area in which a detection or combination of detections occurs, the inability to determine which detector or combination of detectors senses a condition change or combination of condition changes, and the inability to distinguish a break in the current loop due to a fault in the line from an actual detection or combination of detections.

In an effort to at least solve these problems, a method was developed which is described in U.S. patent application Ser. No. 07/322,166 filed on Mar. 13, 1989, allowed Jun. 18, 1990, which is a continuation of U.S. patent application Ser. No. 07/129,158 filed on Dec. 7, 1987. This method solves the problem of determining in which area a detection or combination of detections occurs by connecting each remote area to the central location with separate and distinct communication links. Although this method solves this problem, cost often becomes a significant factor when providing separate wires to a large number of remote areas or to remote areas where the distance to the central location is very large. Secondly, this method solves the problem of determining which detector or combination of detectors senses a condition change by introducing unique impedances into the circuit which correspond to different types of detectors. Analog measurements are then made at the central location to identify the type of condition change or combination of changes detected. Although this method substantially solves the problem of determining which detector or combination of detectors senses a condition change or combination of condition changes, the size of the system becomes a significant factor. As the number of detectors and the number of remote areas grow, it can become increasingly difficult to distinguish which detector or combination of detectors is responsible for the change in impedance at the central location. Therefore, although this method solves the problems set forth above, additional problems frequently arise.

Others have attempted to overcome these and other problems through a method which avoids using separate communication links for each area by connecting remote areas together on a common link in a "bus" manner, a parallel interaction between remote areas. Each remote area then uses the same wire or set of wires to communicate with the central location. One method of communicating along a link of this type includes transmission of unique signals from each remote area to the central location upon detection of a condition change. An example of this method can be seen in U.S. Pat. No. 3,925,763. Each signal contains identification of the type of detection which occurred as well as the remote area in which it occurred. In an apparent effort to overcome potential interference between simultaneous signals from different remote areas, a line-activity sensing mechanism is used. One potential problem with this type of method of communication Is that one remote area may be required to wait an unacceptably long period of time before the line is clear, thus delaying a potentially very important signal. Another problem is related to the ability to determine when line faults occur. This method apparently does not inherently solve this problem without the need for additional signal generating and sensing devices.

Another method for using a continuous communications link between remote areas is a polling method. A polling method is a method by which a scanner device located in the central location polls receiver devices in the remote areas. The scanner transmits a polling signal which is received by all of the receivers, and only one receiver responds to the polling signal by transmitting a response back to the scanner. This method of polling over a continuous communications link inherently solves the problem of identifying a line fault while also providing at least partial solutions to the other problems relating to detector identification, remote area identification, and system cost and size considerations. This method also ensures that no interference between simultaneous signals from separate remote areas will occur.

One polling method includes continually pulsing the common communication link with pulses from the central location at a predetermined frequency to sequentially poll each remote area for responses. Examples of this method are seen in U.S. Pat. No. 3,927,404. Receiver devices within each remote area count the number of pulses and respond between pulses when the number of pulses reaches an assigned number. One disadvantage of this type of polling method is that regardless of the number of remote areas within a system, the number of pulses between two pollings of the same remote area is often the same, depending on the size of the counters in the receivers. In other words, if a counter which counts up to 2048 is used in a system using this method and including only 700 remote areas, the system is serving no function for 1348 cycles of polling pulses, valuable time is wasted. Another potential problem is the sequential loop into which the polling is apparently locked. It would appear to be impossible to address a particular receiver without polling through a requisite number of preceding receivers. Although polling is used in this method, other problems arise from the implementation of a single pulse/counter method of polling.

in general, two problems associated with a polling method arise when there is a need to cover every monitored condition throughout the system in a continuous manner. The first problem concerns the ability of the system to effectively cover every monitored condition. Two or more conditions may often be in off-normal states at the same time. One option of dealing with this problem is to ignore all detections which occur after a first detection. Because they are ignored, later detections which might be more important than the first detection may go unnoticed for an unacceptably long period of time, if not completely ignored. Another option is to utilize a priority method of distinguishing the most important detections and generating a response signal which represents the most important detection. An example of this method is also shown in U.S. Pat. No. 3,927,404. Although the most "important" detection may be communicated, other information is frequently very useful. For instance, if smoke is sensed in an apartment, an "important" detection, the ability to know that a door opened while the fire alarm was sounding, implying that the resident escaped the fire, is not part of a priority method. The priority method does not provide complete coverage of every monitored condition.

The second problem concerns the requirement of continuous coverage. Conditions frequently change from normal states, to off-normal states, and back to normal states very quickly. These momentary off-normal condition changes can be initiated and completed during the time between pollings of a particular receiver. If some type of memory element is not assigned to each possible detection, a detection could go unnoticed, thus the coverage would not be continuous. An example of this method is shown in U.S. Pat. No. 4,562,428. No memory devices are specifically assigned to each possible detection. Detectors which only emit a momentary indication of a change are not adequately accommodated by this type of a system. Although the polling rate may be high and the number of receivers may be low, reducing the likelihood of missing a momentary off-normal condition, the coverage is simply not continuous.

Another problem related to monitoring systems concerns power supply methods. One method of supplying power to remote areas requires that remote power from each remote area be supplied to the detectors. Because one or more remote areas may lose power at any given time, a system which requires that each remote area be remotely powered is, in many cases where continuous coverage is necessary, unacceptably unreliable. Conversely, other types of monitoring systems require that power be supplied to each remote area from the central location and are not equipped to receive power from each remote area. Those types of systems do not adequately accommodate environments requiring cable-less links between the central location and remote areas. Such environments may require that each remote area be powered remotely. Therefore, many monitoring systems are either unacceptably unreliable due to a system-imposed requirement that power be supplied at each remote area or are incapable of accommodating environments requiring cable-less links between the central location and the remote areas because power must be supplied to each remote area from the central location.

Another problem related to monitoring systems concerns the difficulty of providing adequate protection to people residing in the so-called remote areas while providing an appropriate degree of freedom to those people. One example of an environment in which a monitoring system of this type might be utilized is that of a high rise residence building for elderly people. One example of a monitoring system which would commonly be used in this environment is the standard "nurse call" system used in many hospitals and nursing homes. That type system often requires that an elderly person in need of assistance physically move to a call button or pull-chain to alert care personnel of a medical emergency. Depending on the type of emergency, this requirement is often impossible. Some systems have overcome that problem by equipping each monitored person with a personal radio transmitter located in a pendant or wrist-watch which communicates with a radio receiver located in the monitored person's room. Each transmitter is typically coded to only communicate with one particular radio receiver and frequently has a very limited range. Because of these limitations, the monitored person, in order to maintain constant protection, is either restricted to his/her room or must be continually accompanied by care personnel when outside his/her room. Hence, those systems do not, by simple virtue of carrying a pendent transmitter, give a monitored person the ability to roam throughout the complex with continuous protection. This is a severe limitation on the monitored person's freedom to move about and is arguably too high a price for continuous protection.

BRIEF SUMMARY OF THE INVENTION

Briefly described, the present invention comprises an alerting and locating system which provides complete and continuous coverage of all monitored conditions in remote areas from a central location effectively and reliably. The system includes a scanner in a central location which polls receivers in remote areas over a common communication link. As each receiver is polled, it transmits a packet of data back to the scanner relating to monitored conditions. In the preferred embodiment of the present invention, various detectors of different types which monitor different types of conditions are associated with each receiver. Monitored conditions include, but are not limited to: the presence of smoke, the condition of an exterior door or window, the level of a toilet handle, and any need for emergency assistance by any person carrying a radio transmitter which transmits a predefined coded radio signal. The scanner sends data, including address codes, out on the communication link, which data is received by all of the connected receivers. Each receiver compares the received address to a predetermined address uniquely assigned to that receiver. When a receiver makes a positive comparison, the receiver sends condition-related data back to the scanner, which data includes an identifying signal corresponding to any coded radio signal received from any personal transmitter, regardless of its specific code. When a transmitter emits a unique code, all receivers within range of the transmitter include that code in the data sent back to the scanner. Each receiver also compares that code to a unique transmitter code assigned to that receiver and includes the result of that comparison in the data sent back to the scanner.

In this preferred embodiment, the scanner is connected to a controller device, such as a program-driven personal computer. The controller device initiates and regulates the generation of the address codes by the scanner and receives data from the scanner corresponding to the address code generated by the scanner as well as data from the receivers. The controller device processes the data and provides a graphical display of the data received from the scanner, database information relevant to the particular data received from the scanner, and location information calculated from the addresses of all receivers which received a common transmitter code. The controller device also resets the scanner's address generator after the last address used in the system is sent and verifies that all receivers are responding regularly. Also, along with the address codes sent onto the communication link by the scanner, encoded commands from the controller device may be included in the codes sent by the scanner. These codes may then be decoded by the remotely located receivers. Alternately, addresses are generated in the controller device and communicated to the scanner which communicates them to the receivers.

It is therefore an object of the present invention to provide a monitoring system which monitors conditions in remote areas from a central location effectively and reliably. The identity of each detection as well as the area in which the detection occurred is determined with high speed and accuracy.

Another object of the present invention is to provide a monitoring system which includes a centralized scanner which successively polls each remotely located receiver by sending out address codes onto a communication link connected to all of the receivers. The receiver whose address corresponds to the address code sent out by the scanner responds to the polling by sending a data signal back to the scanner which identifies all detections which occurred, including verification that the receiver is still connected to the scanner.

Yet another object of the present invention is to provide a monitoring system which includes a centralized scanner which successively polls each remotely located receiver to receive information from each receiver corresponding to any radio signal received by that receiver. The receiver sends a data signal corresponding to the radio signal received by the receiver, along with the results of a comparison between that signal and a preassigned transmitter code corresponding to the personal transmitter assigned to that transmitter.

Still another object of the present invention is to provide a monitoring system which includes a centralized scanner which successively polls each remotely located receiver by only sending out address codes which correspond to the receivers in the system and automatically resets after reaching a last address maximum, avoiding wasting time by sending out addresses not assigned to receivers in the system.

Still another object of the present invention is to provide a monitoring system which is both capable of supplying power to each remotely located receiver from the central location and capable of accommodating environments requiring cable-less links between the central location and the remote areas by allowing each remotely located receiver to be remotely powered.

Still another object of the present invention is to provide a monitoring system which includes receivers which remember momentary off-normal changes in monitored conditions at least until communication of the occurrence has been transmitted to the scanner.

Still another object of the present invention is to provide a monitoring system including remotely located receivers, a centrally located scanner, and a controlling device which cooperates with the scanner to initiate the generation of an address code by the scanner, receive data from the scanner revealing the address code sent out by the scanner along with data received from the respective receiver revealing detector identities.

Still another object of the present invention is to provide a communication system which includes a centrally located controlling device equipped with a scanner which communicates with remotely located receivers by sending address and command data to the receivers and receiving condition-related data from the receivers.

Still another object of the present invention is to provide a monitoring system which includes a plurality of personal radio transmitters and intelligent receivers interlinked with a computer database and a graphic display system used to identify and locate individuals requesting assistance through a distance calculation technique involving all addresses of receivers receiving a common signal.

Still another object of the present invention is to provide an emergency monitoring system which identifies who has had an emergency, what type of emergency has occurred, when the emergency occurred, and where the emergency occurred.

Still another object of the present invention is to provide a monitoring system for an elderly retirement facility which provides the availability of quick-responding assistance yet preserves the privacy and freedom to move about through common areas for the tenants.

Other objects, features, and advantages of the present invention will become apparent upon reading and understanding the present specification when taken in conjunction with the accompanying drawings.

DETAILED DESCRIPTION OF THE PREFERRED EMBODIMENT

Figure 1:
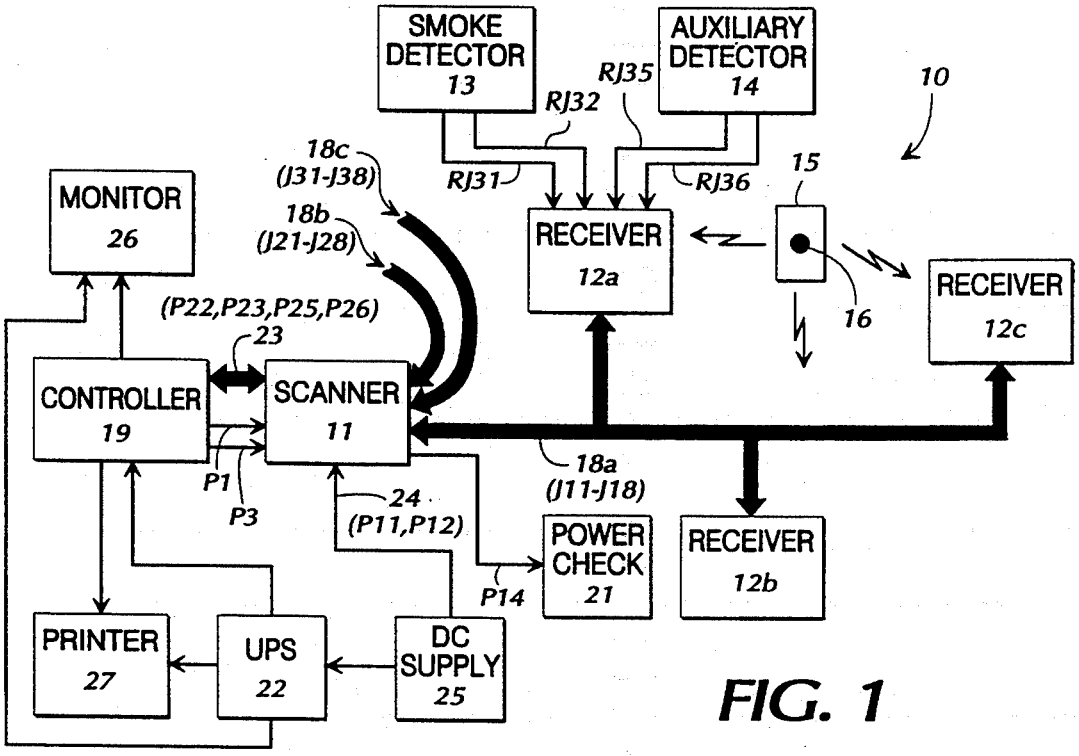
FIG. 1 is a block diagram representation of the preferred embodiment of the present invention.
Figure 1A:
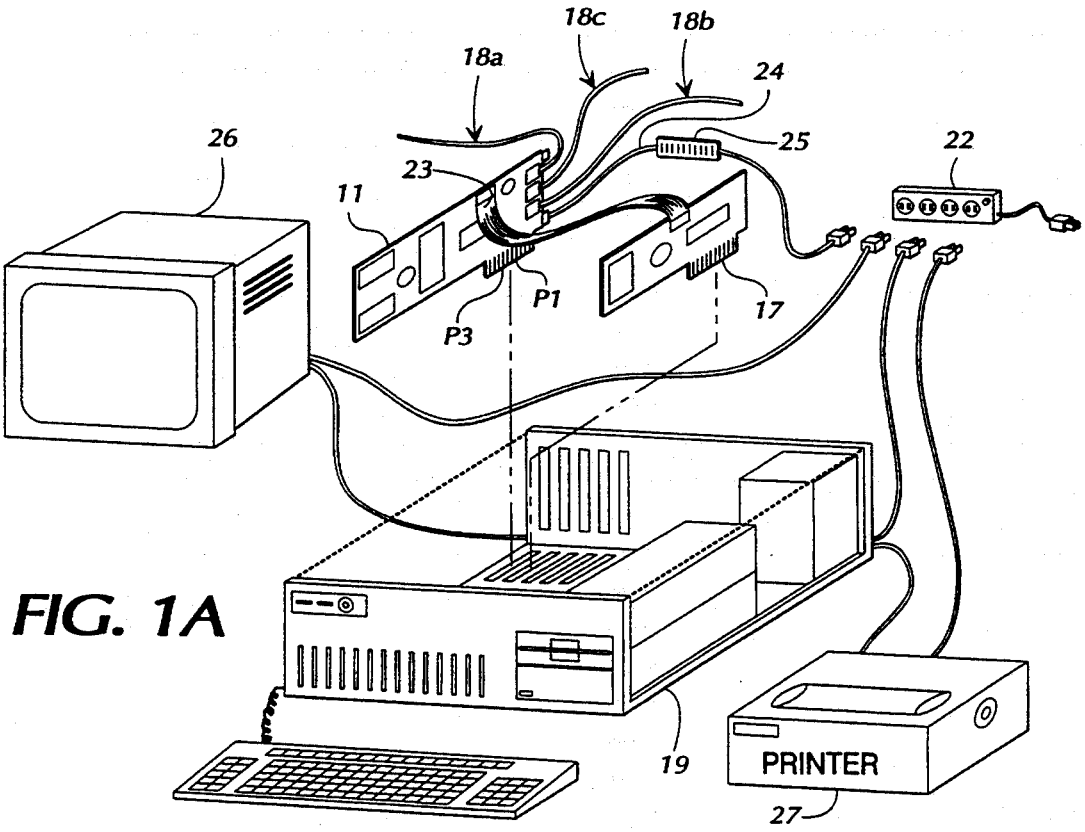
FIG. 1A is a pictorial view of the elements of FIG. 1 which are located at the central location.
Figure 1B:
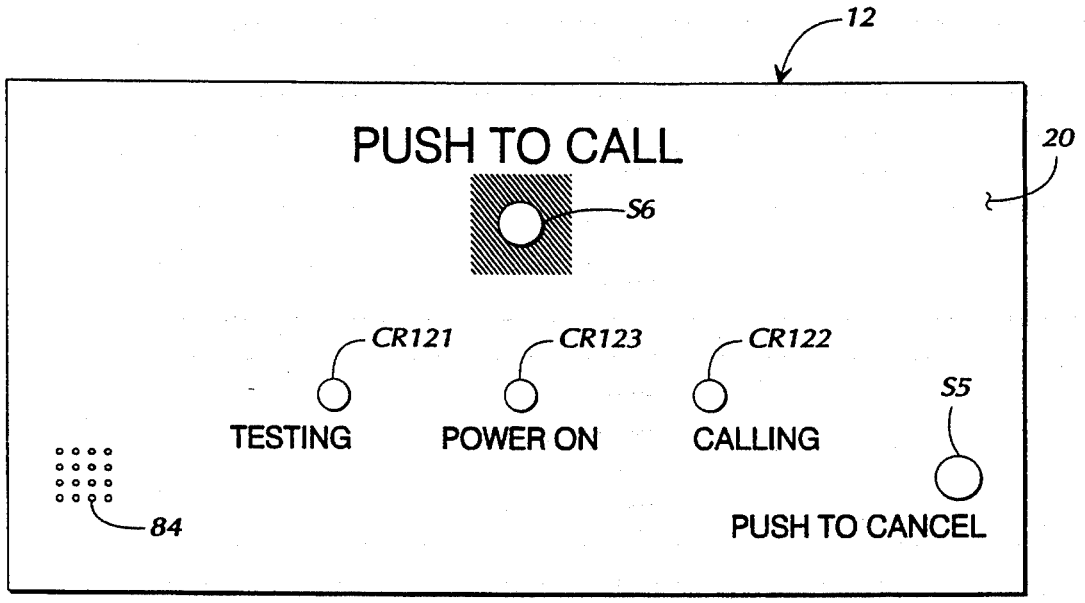
FIG. 1B is a pictorial front view of a first exterior of a receiver shown in block diagram representation in FIG. 1.
Figure 1C:
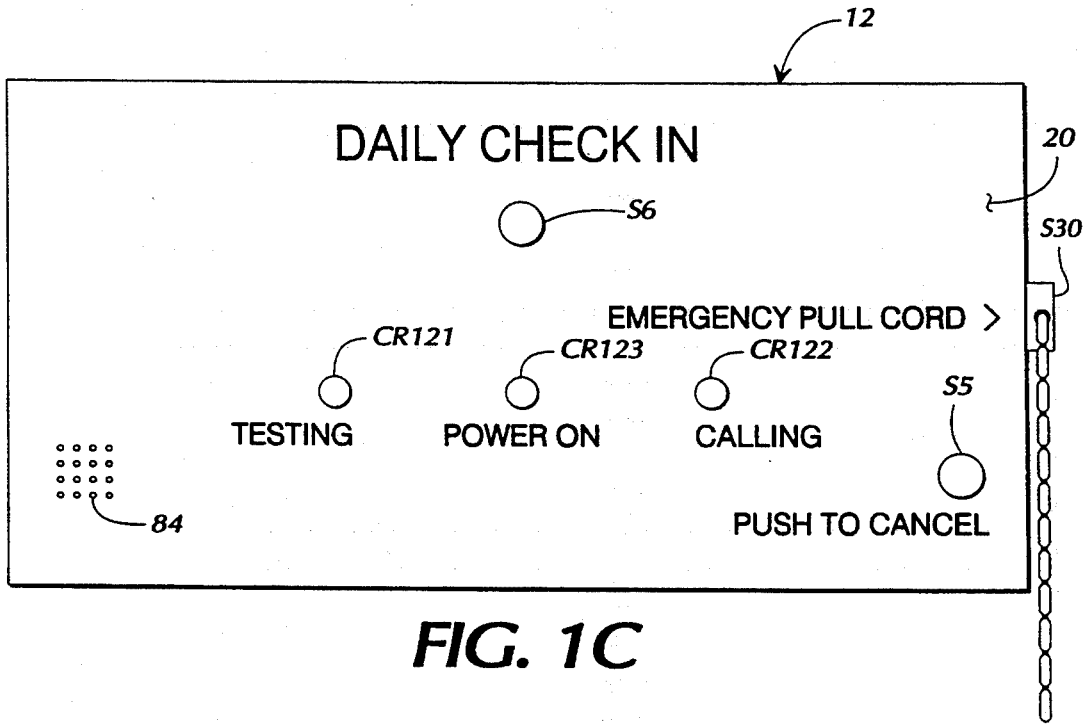
FIG. 1C is a pictorial front view of a second exterior of a receiver shown in block diagram representation in FIG. 1.

SYSTEM DESCRIPTION:

Referring now in greater detail to the drawings in which like numerals represent like components throughout the several figures, the preferred embodiment will now be described. FIG. 1 shows a block diagram representation of the preferred embodiment of the intelligent monitoring system 10. FIG. 1A shows a pictorial view of the elements shown in FIG. 1 which are located at the central location. FIGS. 1B and 1C are pictorial front views of two alternate exteriors 20 of receiver 12*a*. Referring back to FIGS. 1 and 1A, scanner 11 is seen connected to the controller 19 through RS-232 link 23 (P22, P23, P25, and P26) and +V1 power links P1 and P3. The +V2 external power line 24 connects scanner 11 to DC supply 25 which is connected to Uninterruptible Power Supply (UPS) 22. Two acceptable examples of +V1 and +V2 are 5VDC and 24VDC respectively. Alternately, another acceptable example of +V2 is 18VAC, removing the need for DC supply 25. In the preferred embodiment of the present invention as shown in FIG. 1A, scanner 11 is constructed as a circuit board adapter card designed to be placed inside controller 19, one acceptable example of controller 19 being a personal computer as is shown in FIG. 1A. +V1 power links P1 and P2 are defined as pins on the bottom of scanner 11 which receive +V1 power directly from the power bus of controller 19. However, and as is discussed below, scanner 11 may use +V1 power from controller 19 through P1 and P3, or alternately convert +V2 external power into +V1 power. Power check 21 is connected by power check link P14 to scanner 11 to provide external notice of a power failure or overheating in scanner 11.

Although in the present embodiment scanner 11 is designed to be capable of receiving +V1 power directly from the power bus of the controller 19, communication between the controller 19 and scanner 11 is accomplished through RS-232 link 23 and asynchronous communications card 17 contained in the controller 19. Although the scope of the present invention includes alternate embodiments where scanner 11 avoids the RS-232 interface and communicates directly to controller 19 through the other pins on the bottom of scanner 11 card, the preferred embodiment is capable of accommodating a variety of controller structures because of the commonly used RS-232 standard. The present embodiment also provides for easy testing because connections can be made directly to the standard RS-232 link 23. One acceptable example of RS-232 link 23 comprises 4 lines: transmit, receive, ground, and +V2 power sample, corresponding respectively to conductors P22, P23, P25, and P26. Although the preferred embodiment of scanner 11 is a circuit board adapter card placed inside a controller 19, an alternate embodiment of scanner 11 includes a self-contained, external scanner 11. Controller 19 is also connected to monitor 26 and printer 27 which are both also connected to UPS 22 for continuous power.

Communication link 18*a* (J11–J18) connects scanner 11 to remote receivers 12*a*, 12*b*, and 12*c*. Communication links 18*b* and 18*c* are also shown cut away from receivers 12. The exact number of receivers 12 and communication links 18 shown in FIGS. 1 and 1A are not meant to limit the present invention, but merely to suggest a plurality of receivers 12 and communication links 18. Because receiver 12*a* is identical in construction to the other receivers 12*b* and 12*c*, references to a generic receiver 12 or to receiver 12*a* are to be considered applicable to all receivers, including 12*a*, 12*b* and 12*c*, as well as others included by implication but not shown. The same is true from communication links 18. In the preferred embodiment, one acceptable example of the communication link 18 comprises 8 lines: 3 scanner output lines, including 1 ground (J11–J13); 3 receiver output lines, including 1 ground (J14–J16); and +V2 power and ground lines (J17–J18). Alternate embodiments of the communication link 18 include a 4 line link: 2 power and 2 data; as well as a 2 line link with power and data simultaneously supplied over the same 2 lines. Also within the scope of the present invention is an alternate embodiment with cable-less links between all receivers 12 and scanner 11, an acceptable example of a cable-less link being an R.F. data link. Any type of communication link capable of transferring signals is considered within the scope of the present invention because each receiver 12 has the ability to receive power remotely as well as from communication link 18. Additional signal distinguishing hardware, additional power components, and other common elements not shown in the preferred embodiment but well known in the art would be required to implement alternate link structures and are certainly considered within the scope of the present invention.

Receiver 12 is connected to communication link 18 in parallel with scanner 11 as it runs from receiver 12 to receiver 12 in a manner similar to a "bus". FIG. 1A shows the parallel connection of scanner 11 to communication link 18. Receiver 12*a* is also connected to smoke detector 13 along links RJ31 and RJ32, and to auxiliary detector 14 along links RJ35 and RJ36. Also, the number and type of detectors shown is likewise not meant to limit the present invention, but to suggest a plurality of detectors connected to receiver 12. Alternately, it is not necessary that receiver 12 be connected to any detector to properly cooperate with personal transmitter 15. Personal transmitter 15 is designed to be used by any person anywhere within the range of any receiver in the present invention by pressing the transmit button 16.

One application of the preferred embodiment of the present invention is an intelligent monitoring system 10 in a high rise residence for the elderly. In this application a receiver 12 is placed inside each apartment occupied by at least one elderly resident. Other receivers 12 may also be placed in strategic "common areas" such as halls, stairways, meeting rooms, and lunch rooms. It is often desirable to monitor various conditions in each apartment and in the common areas, acceptable examples being the presence of smoke, the condition of doors or windows, the level of a toilet handle, the condition of a check-in button on receiver 12, and a medical emergency experienced by any resident carrying any personal transmitter 15. A resident needing monitoring may be incapable of notifying others through conventional methods such as the telephone or conventional "nurse call" systems or may be in a stairwell or common area outside his/her room. These conditions can be monitored by detectors hard-wired to receiver 12, such as smoke detector 13, auxiliary detector 14 and other hard-wired detectors included by implication, and by personal transmitter 15 working in radio signal conjunction with receiver 12.

When a detector, such as a smoke detector 13, detects a change from a normal state to an off-normal state in a monitored condition, such as the presence of smoke in the apartment, receiver 12 senses that change and remembers it at least until polled by scanner 11 or reset at receiver 12, as is discussed below. When a resident pushes the transmit button 16 on the personal transmitter 15, the personal transmitter 15 emits a unique R.F. code. In most cases, that R.F. code will be heard by more than one receiver 12. All receivers 12 which receive the R.F. code will store the code at least until polled by scanner 11, as is discussed below. If the unique R.F. code matches the unique code assigned to a particular receiver 12, that receiver 12 will also remember that match and will activate an emergency light and sounding device for user feedback.

In the preferred embodiment, controller 19 initiates an address generation in scanner 11 by sending signals over RS-232 link 23 to scanner 11. Through signals from controller 19, an address counter in scanner 11 is incremented until a desired address is reached, at which time controller 19 instructs scanner 11 to send out the address over communication link 18. An additional function allows command signals from controller 19 to also be sent out on communication link 18. Lights, speakers, doors, and a host of other devices may be controlled through these commands. It is also within the scope of the present invention for controller 19 to communicate actual addresses over RS-232 link to scanner 11 for transmission to receivers 12, as opposed to scanner 11 generating each address.

In the preferred embodiment, the address codes correspond to addresses uniquely assigned to each receiver 12. When polled by scanner 11, each particular receiver 12 is being requested by scanner 11 to respond with information relating to the monitored conditions. Receiver 12 responds by transmitting an encoded receiver data packet back to scanner 11 which corresponds to changes in the states of monitored conditions which occurred since that particular receiver 12 was last polled, and which corresponds to off-normal states of certain monitored conditions which were also in off-normal states during the previous polling, depending on whether receiver 12 is configured to continue signaling an off-normal state for a particular condition. When referring to "the previous polling", it should be understood that in this preferred embodiment, and as is discussed below, receiver 12 actually remembers an off-normal state of a monitored condition through at least two pollings by scanner 11 to provide a greater degree of data integrity. Of course, this additional feature does not limit the present invention from being configured to only remember condition data until once polled by scanner 11. Receiver 12 also has a manual reset function which changes this remembering scheme, also discussed in greater detail below.

It is important to remember that every receiver 12 which receives a transmitter signal from a personal transmitter 15 will communicate that particular transmitter code to scanner 11 when polled. There could conceivably be times when two or more personal transmitters 15 are activated within range of a receiver 12 between pollings. There are several methods for responding this situation. One option is to ignore the possibility and allow the second signal received by receiver 12 to replace the first signal, risking loss of the first signal. A second method would lock out all signals received after the first signal is received by receiver 12, risking loss of the second signal. Besides providing these options, the present invention includes a third option which offers the best method for many environments. Each code received by receiver 12 is compared to an assigned code to generate a match signal upon successful comparison. That match signal is used to lock out other signals received after the code assigned to that particular receiver 12 is received. With this option, the best of both the first two options is provided, both signals are eventually communicated to scanner 11.

Having received a receiver data packet from receiver 12, scanner 11 transmits that packet, as well as a sample of the data sent out from scanner 11 onto communication link 18, to controller 19 over RS-232 link 23. With the help of a controller program and the data sent to it from scanner 11 over RS-232 link 23, controller 19 processes the data to identify who's condition changed, what type of condition changed, when the condition changed, and where the condition changed. That information, along with medical information corresponding to the resident assigned to a particular receiver 12, can then be graphically displayed on display 26 and printed on printer 27. In the event of a power outage, UPS 22 ensures proper operation of the intelligent monitoring system 10 by providing continuous power to the system. Power check 21, however, monitors against power loss and overheating in scanner 11.

The controller program employs a concurrent processing method which enables several tasks to be performed virtually simultaneously. Controller 19, at some point in time after receiving signals from receiver 12 or the lapse of predetermined amount of time, again sends address and polling signals to scanner 11 instructing it to poll the next receiver 12. Also, new commands may be sent to the same receiver 12 before polling the next address. This is discussed in greater detail below.

It should be understood that the elderly residence environment discussed above is only one of many environments in which monitoring system 10 could be utilized. Other environments and applications include homes, commercial sky-scrapers, warehouses where employees are monitored, and even vehicle monitoring on a very large scale where sophisticated wire-less communication links including satellites are utilized. Because commands from controller 19 can be sent to specific receivers 12, a true data communication link is created which can be utilized for a myriad of applications.

Figure 2:
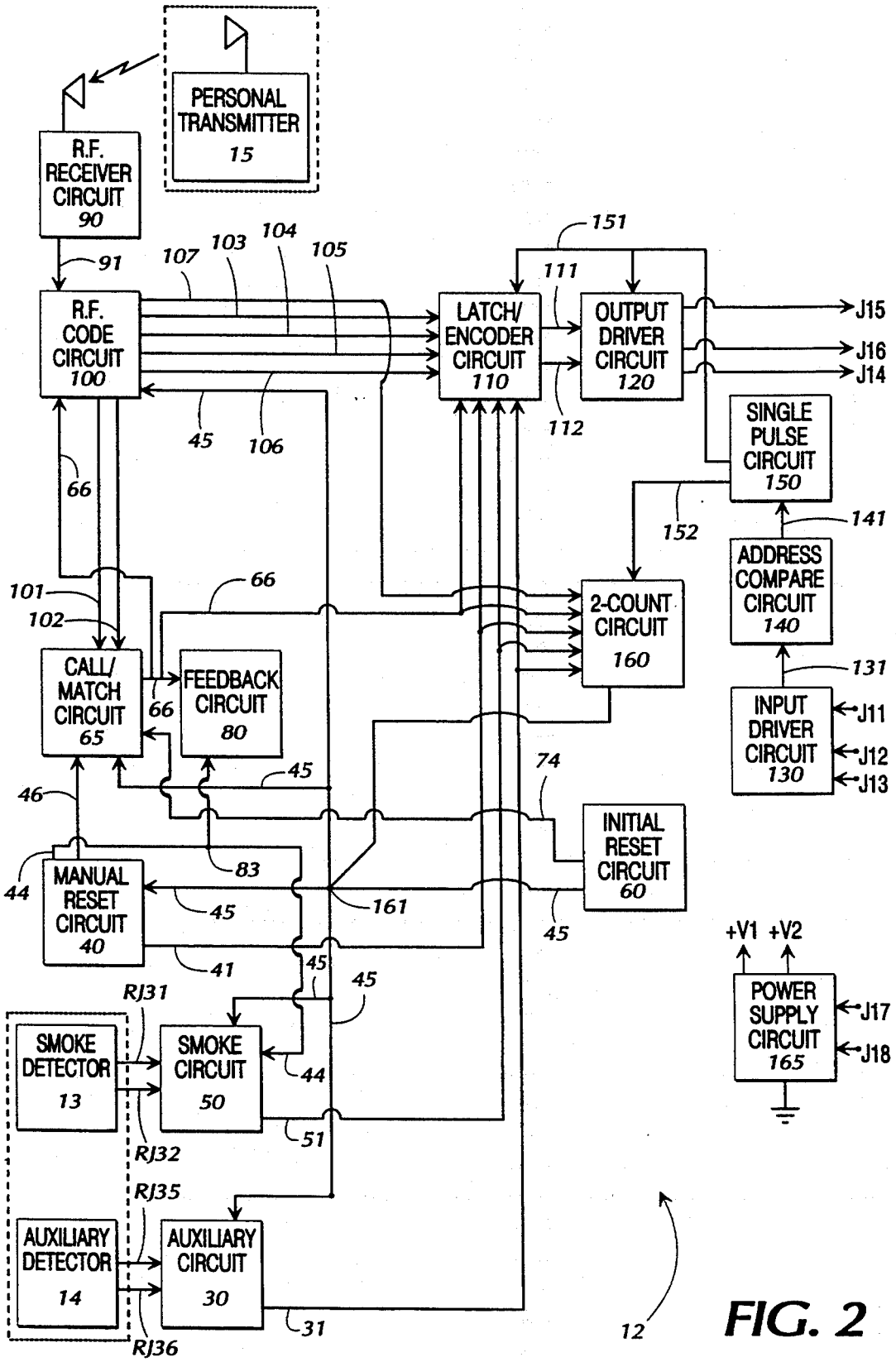
FIG. 2 is block diagram representation of a preferred embodiment of the receiver shown in FIG. 1.

RECEIVER DESCRIPTION:

Referring now, and throughout the discussion regarding receiver 12, to FIG. 2, the preferred embodiment of receiver 12 is represented in block diagram representation with smoke detector 13, auxiliary detector 14, and personal transmitter 15 separated from receiver 12 by dotted lines. Generally described, indications of off-normal conditions are sensed and stored by auxiliary circuit 30, smoke circuit 50, manual reset circuit 40, call/match circuit 65, and personal transmitter R.F. receiver circuit 90 working in conjunction with R.F. code circuit 100. Signals received by those circuits have paths to latch/encoder circuit 110. Receiver input driver circuit 130 receives polling information from scanner 11 through links J11–J13. Receiver input driver circuit 130 purifies the incoming polling information and provides the information to address compare circuit 140 over receiver input driver output line 131. Address compare circuit 140 decodes the information and compares the address contained in the information to a unique address assigned to receiver 12. If the comparison is favorable, indicating that receiver 12 is currently being polled, a signal is generated over compare output line 141 to single pulse circuit 150. Single pulse circuit 150 generates a momentary pulse on single pulse line 151 to latch/encoder circuit 110 and output driver circuit 120. When latch/encoder circuit 110 receives a momentary pulse on single pulse line 151, it encodes the signals from the detector circuits into a receiver data packet to be sent back to scanner 11. The receiver packet is output over code output line 112 and inverted code output line 111 to receiver output driver circuit 120. With single pulse line 151 still high, receiver output driver circuit 120 drives the receiver data packet through links J14–J16 to scanner 11.

Single pulse circuit 150 also generates a momentary inverted pulse on inverted single pulse line 152 which is an inverted version of the signal sent out on single pulse line 151. 2-count circuit 160 receives the signal on inverted single pulse line 152 and inputs the signal into a counter. Each time a signal is generated by a detector circuit, 2-count circuit 160 is reset by this detector circuit line 31, 41, 51, 66 and 107. If no additional signals are received from the detector circuits after a second polling, 2-count circuit 160 will generate a 2-count reset signal on 2-count reset line 45 after the second polling which attempts to reset the memory storage devices in each detector circuit. As the second momentary inverted pulse on inverted single pulse line 152 rises, 2-count circuit 160 emits a 2-count reset signal on 2-count reset line 45. Initial reset circuit 60 is a power-up circuit that initially clears the memory storage devices by holding 2-count reset line 45 low for an initial amount of time after power is first supplied to receiver 12. Feedback circuit 80 provides local audio and visual feedback to a user for certain specified alert conditions. Other functions of receiver 12 will become more evident as each circuit shown in block diagram representation in FIG. 2 is described in detail with a preferred embodiment schematic representation in the following discussion.

Auxiliary circuit 30 is seen connected to auxiliary detector 14 by links RJ35 and RJ36. Auxiliary detector 14 can generally be a transducer element or detector of a type which in effect closes a normally open switch or opens a normally closed switch. It is also considered to be within the scope of the present invention to substitute detector 14 with a plurality of detectors 14 connected in series, if normally closed, or parallel, if normally open. Auxiliary circuit 30 responds to the switch movement of auxiliary detector 14 by storing a signal representing the occurrence and notifying latch/encoder circuit 110 along auxiliary output line 31 of the occurrence. This notification continues until: 1) auxiliary detector 14 no longer detects the off-normal state of the monitored condition and auxiliary circuit 30 is told to "forget" the occurrence by a signal on 2-count reset line 45; or 2) simply when auxiliary circuit 30 is told to "forget" the occurrence by a signal on 2-count reset line 45, regardless of the state of the monitored condition. This is an option provided by receiver 12 and is discussed in greater detail below. 2-count reset line 45, as discussed above, delivers a signal attempting to reset certain memory functions due to a 2-count reset from the 2-count circuit 160 or the initial (power-up) reset circuit 60.

Figure 4:
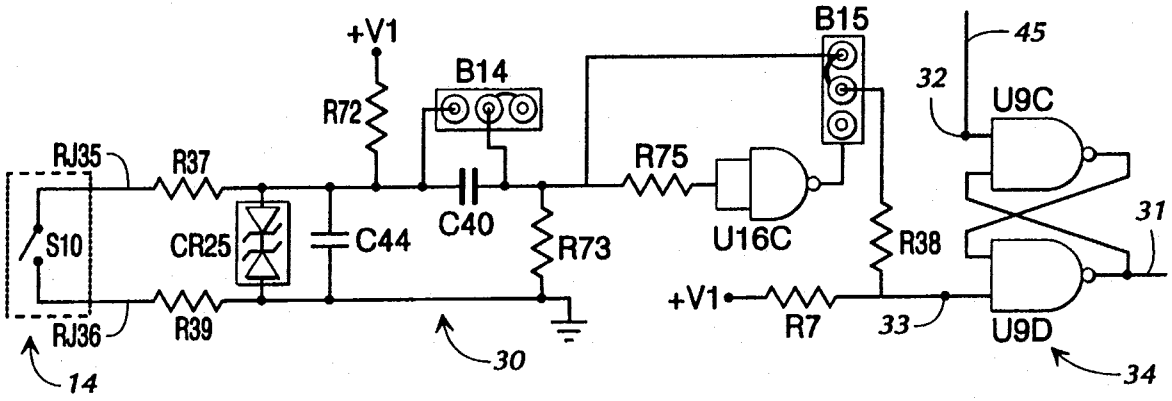
FIG. 4 is a schematic representation of the auxiliary circuit shown in FIG. 2.

FIG. 4 is a schematic diagram of auxiliary circuit 30 shown in block form in FIG. 2. +V1, +V2, and ground are considered available throughout all receiver circuits from receiver power supply circuit 165. Auxiliary circuit 30 is designed to accommodate a variety of detectors. As mentioned above, it is capable of responding to the closing of a normally open switch or the opening of a normally closed switch. It is also capable of generating a sustained or a momentary response to a switch movement. In FIG. 4, auxiliary detector 14 is seen outlined by a dotted line and represented by normally open switch S10. Auxiliary output line 31 is seen connected to the output of auxiliary flip-flop (FF) 34, the memory device for auxiliary circuit 30. Auxiliary output line 31 is normally "low", (corresponding to a voltage of which an acceptable example is 0V, or ground) and goes "high" (corresponding to a voltage of which an acceptable example is +V1, or +5V) when auxiliary FF 34 is set as a result of a switch movement in auxiliary detector 14. It can be seen that auxiliary FF 34 is set by providing a low to auxiliary FF set 33 and is reset by providing a low to auxiliary FF reset 32, which is connected to 2-count reset line 45. When auxiliary FF set 33 has a path to ground, auxiliary FF 34 is set until it is reset with a low on 2-count reset line 45. Resistor R7 keeps auxiliary flip-flip set 33 high until it is grounded along a path through resister R38.

Depending on the orientations of jumpers B14 and B15, there are four different paths to ground for auxiliary FF set 33. Jumper B15 is used to alternately configure auxiliary circuit 30 to respond to movements of normally open or normally closed switches S10. Jumper B14 is used to alternately configure auxiliary circuit 30 to respond with a momentary or sustained output. The purposes for momentary vs. sustained outputs concern the type of condition detected. If the condition requires immediate response from a care giver, such as an intruder alert, a sustained response is more desirable. However, if the condition monitored does not require immediate response, such as the opening of a sliding glass door that remains open, a momentary response only long enough to set auxiliary FF 34 so that controller 19 may simply record the occurrence is more desirable.

The first configuration is shown in FIG. 4. Auxiliary circuit 30 is configured to respond to the closing of a normally open switch S10 with a momentary response. When switch S10 closes, a path to ground from auxiliary FF set 33 is created through resistor R38, jumper B15, capacitor C40 (because there is no initial charge on capacitor C40), resistor R37, switch S10, and resistor R39. As capacitor C40 charges from the current supplied through resistors R7 and R38, capacitor C40 opens to remove the ground to auxiliary FF set 33, making auxiliary FF 34 vulnerable to a reset signal from 2-count reset line 45 at auxiliary FF reset 32. As discussed above, some detections, such as the opening of a sliding glass door, or the flushing of a toilet, may not be serious enough to warrant continued signal generation by receiver 12. If a mercury level switch were used to detect the flushing of toilet by monitoring the level of the toilet handle, the handle could still be in an off-normal condition for an extended period of time, but receiver 12 would only remember the occurrence until auxiliary FF 34 is reset by 2-count reset line 45. By switching pins on jumper B14, capacitor C40 can be removed from the circuit, providing auxiliary FF set 33 a constant path to ground as long as switch S10 is closed. This second configuration would prevent 2-count reset line 45 from resetting auxiliary FF 34 until switch S10 is again opened, ie. until the condition monitored by auxiliary detector 14 has returned to a normal state. This is a useful configuration for detectors such as a smoke detector.

Jumper B15 acts in a similar manner to jumper B14 to selectively remove a portion of the circuit from the path between auxiliary FF set 33 and ground. By switching pins on jumper B15, current limiting resistor R75 and NAND gate U16C are added to the ground path, allowing for the use of a normally closed switch S10. The third configuration involves jumper B14 configured as shown in FIG. 4, and jumper B15 set alternately from that shown in FIG. 4. In this arrangement, auxiliary circuit 30 is configured to respond to the opening of a normally closed switch with a momentary response. NAND gate U16C is wired to operate as an inverter. In the normal state, switch S10 is closed, providing a path to ground for the input of NAND gate U16C through resistors R75 and R73. As switch S10 is opened, +V1 is supplied to the input of NAND gate U16C through resistor R75, across capacitor C40 momentarily, and through resistor R72. NAND gate U16C inverts the +V1 signal and outputs a low. Auxiliary FF set 33 then again has a path to ground, but this time to the output of NAND gate U16C. Again, as capacitor C40 charges to the +V1 supplied to it through R72, it opens the circuit and removes the +V1 supplied to the input of NAND gate U16C. As before, the auxiliary FF 34 is then ready to be reset by 2-count reset line 45.

The fourth configuration accommodates the opening of a normally closed switch S10 with a sustained response. Jumpers B14 and B15 would both be configured alternately to the configuration shown in FIG. 4. Capacitor C40 would be effectually removed from the circuit, but resistor R75 and NAND gate U16C would be included in the path. The operation would proceed as described in the third configuration with the exception of the effect of capacitor C40. The auxiliary FF would remain set until switch S10 was caused to close. The transient voltage suppressor (TVS) CR25 cooperates with resistors R37 and R39 and capacitor C44 to reduce the transient and noisy effects of static and other undesirable noisy signals.

Referring back to FIG. 2, smoke circuit 50 is attached to smoke detector 13 through lines J31 and J32. Smoke circuit 50 responds to indications of the detection of smoke by smoke detector 13. Output from smoke circuit 50, representing the presence of smoke detected by smoke detector 13, is sent along smoke output line 51 to latch/encoder circuit 110. That output continues until smoke detector 13 no longer detects smoke and smoke circuit 50 is told to "forget" the detection with a reset signal over 2-count reset line 45. Because the presence of smoke requires an immediate response from the care giver, smoke circuit 50 requires both the absence of smoke and then a signal over the 2-count reset line 45 to reset the memory of smoke circuit 50. FIG. 2 also shows acoustic feedback line 44 connecting smoke circuit 50 to feedback circuit 80. This line gives the present invention the ability to deliver acoustic feedback from the user feedback circuit 80 in response to detection of smoke by smoke detector 13, providing a sound in the same room as receiver 12 which may be located a large distance away from smoke detector 13.

Figure 5:
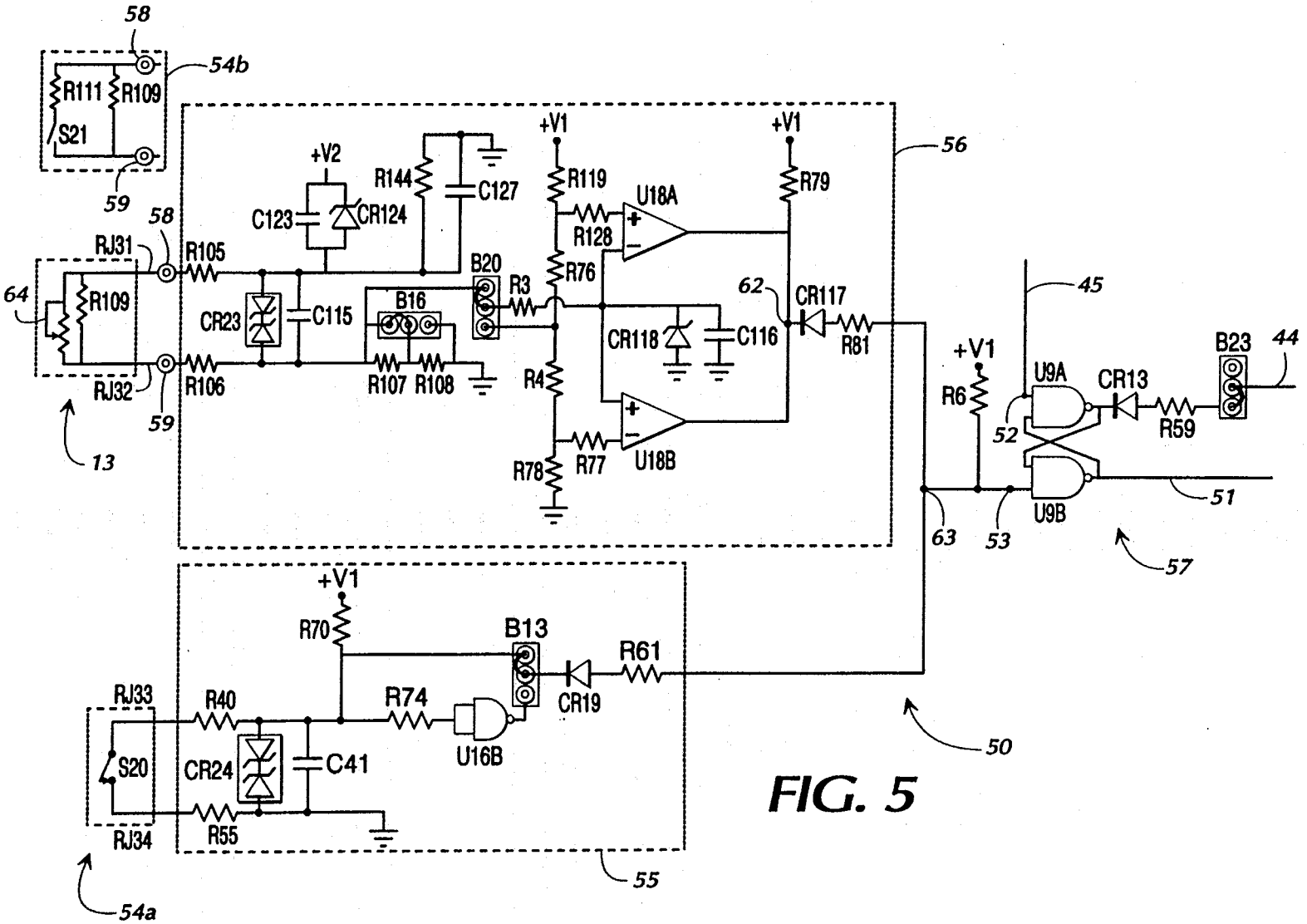
FIG. 5 is a schematic representation of the smoke circuit shown in FIG. 2.

FIG. 5 is a schematic representation of the preferred embodiment of smoke circuit 50 and smoke detector 13 shown in block representation in FIG. 2. Smoke detector 13 is again separated from smoke circuit 50 by dotted lines. Additional dotted lines delineate two major portions of smoke circuit 50, switch movement circuit 55 and voltage window circuit 56. In the smoke detector industry, several different types of smoke detectors are manufactured, a number of which are accommodated by the present invention. The first type of smoke detector is shown by smoke detector 13. Smoke detector 13 receives power from smoke circuit 50 through links RJ31 and RJ32. Variable resistor 64 represents an equivalent variable resistance to the internal resistance of smoke detector 13. When smoke is detected, the internal resistance goes from a very large value to a small value, drawing more current, which is sensed by voltage window circuit 56. Resistor R109 is a trickle resistor added to smoke detector 13 that continuously draws a small amount of current which is sensed by voltage window circuit 56 which responds to a fault in the line, such as an open circuit resulting from damage to RJ31 and RJ32 or the actual disconnection and removal of smoke detector 13, which stops the current flow through trickle resistor R109. Thus, both alarm condition and line fault condition are sensed by voltage window circuit 56. Voltage window circuit 56 is discussed in greater detail below.

Alternate smoke detectors, represented by alternate smoke detectors 54*a* and 54*b*, are also accommodated by smoke circuit 50. Alternate smoke detector 54*b* represents a smoke detector which is powered remotely, independent of receiver 12. Points 58 and 59 correspond to the points at which alternate smoke detector 54*b* would be connected to links RJ31 and RJ32 if alternate smoke detector 54*b* were used instead of smoke detector 13. Switch S21 is a normally open switch which is an element of alternate smoke detector 54*b*. Resistors R111 and R109 are added to alternate smoke detector 54*b* to cooperate with voltage window circuit 56. R111 is similar in size to the low equivalent resistance 64 of smoke detector 13 when smoke detector 13 detects smoke. As switch S21 closes, an increased amount of current flows through RJ31 and RJ32 and is sensed by voltage window circuit 56 in a similar manner to the increased current flow observed with smoke detector 13. Likewise, trickle resistor 109 is used in the same capacity as previously mentioned.

Alternate smoke detector 54*a* represents two other types of alternate smoke detectors. A common type of smoke detector is the remotely powered, normally closed smoke detector. With that type of smoke detector, a current passes through the normally closed switch and ceases to flow when smoke is detected or when a line fault occurs. Switch movement circuit 55 is used to detect switch movement of switch S20. In that arrangement, a fault cannot be distinguished from an alarm condition. A solution to that problem would be to, in addition to running RJ33 and RJ34 out to smoke detector 54*a*, also run RJ31 and RJ32 out to smoke detector 54*a* with trickle resistor R109 simply attached to smoke detector 54*a* with no electrical relationship to smoke detector 54*a*. Trickle resistor R109 could then be used to sense a fault condition through voltage window circuit 56, independent of the alarm condition sensed by switch movement circuit 55. Alternate smoke detector 54*a* also represents the type of smoke detector which is powered remotely but will not accommodate any added resistors, such as resistors R109 and R111. In that case, RJ33 and RJ34 are supplied to smoke detector 54*a* to sense the opening of normally closed switch S20 or the closing of normally closed switch S20. Switch S20 merely represents a switch which is either normally open or normally closed. Obviously, in this alternate embodiment, only a limited amount of distinction is possible between a line fault and an alarm condition. If switch S20 is normally open, the alarm condition would be sensed by switch movement circuit 55, but a line fault could go unnoticed. Alternately, if switch S20 is normally closed, a line fault would give the same result as an alarm situation, a result often considered acceptable.

Turning back to voltage window circuit 56, it should be understood that connecting other types of current sensitive detectors to RJ31 and RJ32 is within the scope of the present invention. Voltage window circuit 56 provides power to smoke detector 13 and senses changes in current which flows through smoke detector 13 by monitoring a related voltage. If the related voltage varies above or below a "voltage window", an output signal, represented in the preferred embodiment as a low, is supplied to smoke FF 57 to generate an output signal along smoke output line 51. Zener CR124 is seen connected to +V2 and line J31. Zener CR124 limits the voltage supplied to smoke detector 13. Capacitors C123, C127, C115, resistors R105, R106 and R144, as well as TVS CR23 all cooperate to, among other things, reduce the transient and noisy effects of static and other undesirable noisy signals in voltage window circuit 56, including reducing the effects of high energy impulses such as lightning.

The voltage at point 61 is a reference voltage related to the current which flows through smoke detector 13. Resistors R107 and R108 cooperate with jumper B6 to provide a plurality of resistances to properly cooperate with different types of smoke detectors 13 with varying operating impedances and provide a reference voltage at point 61. If the reference voltage at point 61 varies above the voltage supplied to the + terminal of comparer U18A or below the voltage supplied to the − terminal of comparer U18B, the voltage at point 62 will be pulled down to set smoke FF 57. Of course, separate flip-flops could be used to distinguish the different conditions. The voltages at the + terminal of comparer U18A and the − terminal of comparer U18B are determined by the values of resistors R119, R76, R4, and R78 which are connected to +V1. In this preferred embodiment, those voltages are approximately 2V and 0.2V, respectively. If the smoke detector 13 detects smoke, the impedance level of the smoke detector 13 decreases, resulting in more current flowing through smoke detector 13, leading to a higher reference voltage at reference point 61, which would then cause comparer U18A to output a low signal to point 62. On the other hand, if smoke detector 13 were disconnected from smoke circuit 50, no current would flow across trickle current resistor R109, and no voltage would appear at reference point 61, thus comparer U18B would output a low to point 62. When a low is supplied to point 62, smoke FF set 53 has a path to ground and sets smoke FF 57. Resistors R3, R128, and R77 serve to limit current to comparers U18A and U18B. Zener CR118 limits the voltage level at reference point 61, and capacitor C116 aids in noise elimination. Jumper B20 provides a convenient method for disabling the comparers U18A and U18B for shipping purposes. By linking reference point 61 to a point between resistor R76 and R4, comparers U18A and U18B are prevented from emitting low signals without the need for a resistor across lines J31 and J32 drawing current. Resistor R79 connected to +V1 pulls up the voltage at point 62 in the absence of low signals from comparers U18A and U18B. Diode CR117 ensures proper operation of the wired OR 63. That is, diodes CR117 and CR19 prevent a high from either point 68 or jumper B13 from interfering with a low from the other. Resistors R81 and R61 prevent a harmful direct shorting in the event either diode CR117 or CR19 were to fail and also limits the current into smoke FF 57 due to any human static discharge particularly while moving B13.

Switch movement circuit 55, combined with smoke FF 57, functions similarly to auxiliary circuit 30 shown in FIG. 4 in many respects. Capacitor C40, jumper B14, and resistor R73 shown in FIG. 4, have no equivalents in switch movement circuit 55. Because of their absence, smoke circuit 50 cannot emit a momentary output along smoke output line 51. This is done on purpose in order to provide only a continuous reporting of smoke while smoke detector 13 is active. This option requires the absence of smoke and a reset signal from 2-count reset line 45 to reset smoke FF 57. Also, diode CR19 in FIG. 5 has no equivalent element in FIG. 4, there being no wired OR in FIG. 4. With those exceptions, smoke circuit 50 functions generally similarly to auxiliary circuit 30. It responds to the closing of a normally open switch or the opening of a normally closed switch, selected by jumper B13, by providing a path from smoke FF set 53 to ground. Resistor R6 normally functions to pull smoke FF set 53 up to +V1. With jumper B8 configured as shown, a path to ground from smoke FF set 53 exists through resistor R61, diode CR19, jumper B13, resistor R40 and resistor R55. This configuration responds to the closing of a normally open switch. Alternately, with jumper B13 configured in the alternate configuration, a low can be delivered to smoke FF 57 from the output of NAND gate U16B. +V1 is normally connected to the input of NAND gate U16B through resistors R70 and R79. In that configuration, smoke circuit 50 responds to the opening of a normally closed switch by removing the path to ground from the input of NAND gate U16B. As this ground is removed, the input of NAND gate U20B is pulled up to +V1 through resistors R70 and R79. As the input to NAND gate U16B goes high, the output goes low, supplying ground to smoke FF set 53. TVS CR24 cooperates with resistors R40 and R55 and capacitor C41 to reduce the transient and noisy effects of static and other undesirable noisy signals, including the effects of high energy transients such as lightning.

Regardless of whether voltage window circuit 56 or switch movement circuit 55 supplies a low to wired OR 63, smoke FF set 53 has a path to ground which sets smoke FF 57. Both of these signals continue until smoke is no longer detected. Smoke output line 51 stays low until a reset signal is sent over 2-count reset line 45 and the low is removed from smoke FF set 53. Also, an output is taken from U9A through diode CR13, resistor R59 and jumper B23 along acoustic feedback line 44. Acoustic feedback line 44 is included to provide a signal to feedback circuit 80 to deliver acoustic feedback from the feedback circuit 80 in response to detection of smoke by smoke detector 13. Referring also to FIG. 2, manual reset circuit 40 is also connected to feedback circuit 80 along acoustic feedback line 44. A wired OR exists at point 83. Diode CR13 and resistor R59 isolate smoke circuit 44 from manual reset circuit 40 by functioning in the previously disclosed wired OR manner. Jumper B23 enables and disables the acoustic feedback function.

Referring back to FIG. 2, manual reset circuit 40 is shown in block diagram representation. FIGS. 1B and 1C denote switch S5 which corresponds to the manual reset button. Manual reset circuit 40 serves many purposes in the present embodiment. The first function is to manually reset the memory device in call/match circuit 65 along manual reset line 46. 2-count circuit 160 and initial reset circuit 60 provide reset signals to 2-count reset line 45, as is discussed above. A second function is to provide an output signal along manual reset output line 41 to latch/encoder circuit 110. In the preferred embodiment, computer 19 eventually receives this signal and interprets it in at least two different ways. If call/match circuit 65 had been previously set and received by computer 19, a signal from manual reset circuit 40 is interpreted as a test. However, if no other signal had been received, receipt of this signal is interpreted as a daily check in by the resident. Yet another function of manual reset circuit 40 is provide a signal to feedback circuit 80 through acoustic feedback line 44 to provide acoustic feedback when manual reset circuit 40 is activated.

Figure 6:
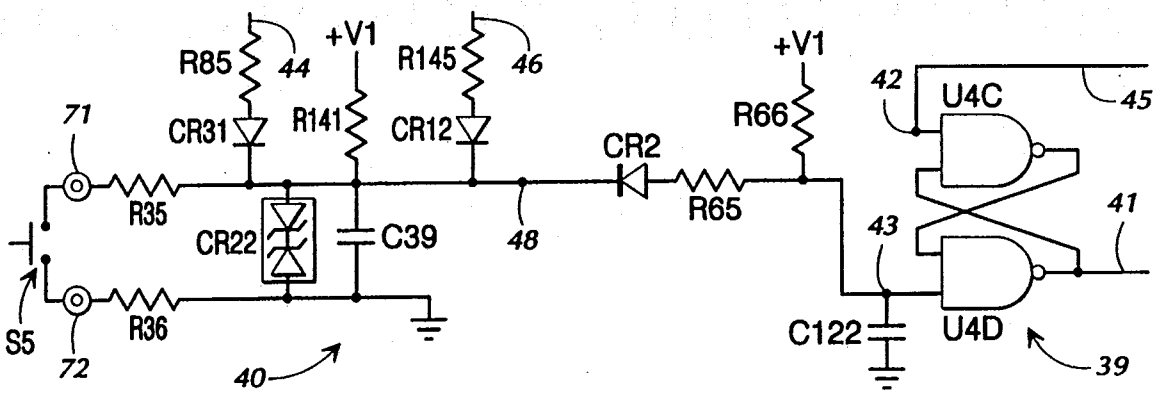
FIG. 6 is a schematic representation of the manual reset circuit shown in FIG. 2.

FIG. 6 is a schematic representation of the preferred embodiment of manual reset circuit 40. In the preferred embodiment, a momentary, normally open switch, represented by switch S5 and indicated by "PUSH TO CANCEL" in FIGS. 1B and 1C, is located on the exterior of receiver 12. As utilized in previously mentioned circuits, TVS CR22, resistors R35 and R36 and capacitor C39 cooperate to reduce the transient and noisy effects of static and other undesirable noisy signals. Point 48 is normally high due to pull-up resistor R141 which is connected to +V1. When switch S5 is closed, point 48 is essentially grounded across resistors R35 and R36 which are relatively small in the preferred embodiment.

Manual reset line 46 connects point 48 of manual reset circuit 40 to call/match circuit 65 through diode CR126 and resistor R145. Call/match circuit 65 receives reset signals from manual reset line 46, from 2-count reset line 45, and from initial reset circuit 60. These various reset options are discussed below. When point 48 goes low, manual reset FF set 43, which is normally high due to pull-up resistor R66, is pulled low through diode CR2 and resistor R65 and sets manual reset FF 39. Capacitor C112 provides additional noise immunity. Manual reset FF 39 will then stay high until reset by a signal from 2-count circuit 160 or initial reset circuit 60 on 2-count reset line 45. After manual reset FF 39 is set, manual reset output line 41 sends a low signal to latch/encoder circuit 110. That signal will eventually reach computer 19 and will be treated appropriately as discussed above.

Also, manual reset circuit 40 is connected to feedback circuit 80 by acoustic feedback line 44 and through diode CR31 and resistor R85 which also function in the previously described wired OR manner at wired OR 83, shown in FIG. 2.

Referring back to FIG. 2, call/match circuit 65 is seen in block diagram representation. In this preferred embodiment, call/match circuit 65 also serves many purposes. The first function is to detect the pushing of the "PUSH TO CALL" button, designated switch S6 and shown in FIG. 1B and/or the pulling of the "EMERGENCY PULL CORD", designated switch S30 and shown in FIG. 1C. A memory device in call/match circuit 65 stores either of those detections to provide an output along call/match output line 66 to latch/encoder circuit 110 similarly to match reset circuit 40, smoke circuit 50 and auxiliary circuit 30. Call/match circuit 65 has the unique ability to, in addition to allowing a reset signal from initial reset circuit 60 along initial reset line 74 to reset the aforementioned memory device, alternately allowing either a reset signal on manual reset line 46 or 2-count reset line 45, or a reset signal only on manual reset line 46, to function as the reset source for the aforementioned memory device. Call/match circuit 65 receives other inputs besides indications of switch movements by switches S6 and S30. All-code flag line 101 and match-code flag line 102 deliver signals from R.F. code circuit 100. Either all-code flag line 101 or match-code flag line 102 is connected to the aforementioned memory device. These two flag lines are discussed in more detail below. In addition to providing output to latch/encoder circuit 110 along call/match output line 66, that output is also provided to feedback circuit 80. That output is also provided to R.F. code circuit 100 to function with a match lock-out function which prevents processing of signals received after a matching R.F. code is received.

Figure 7:
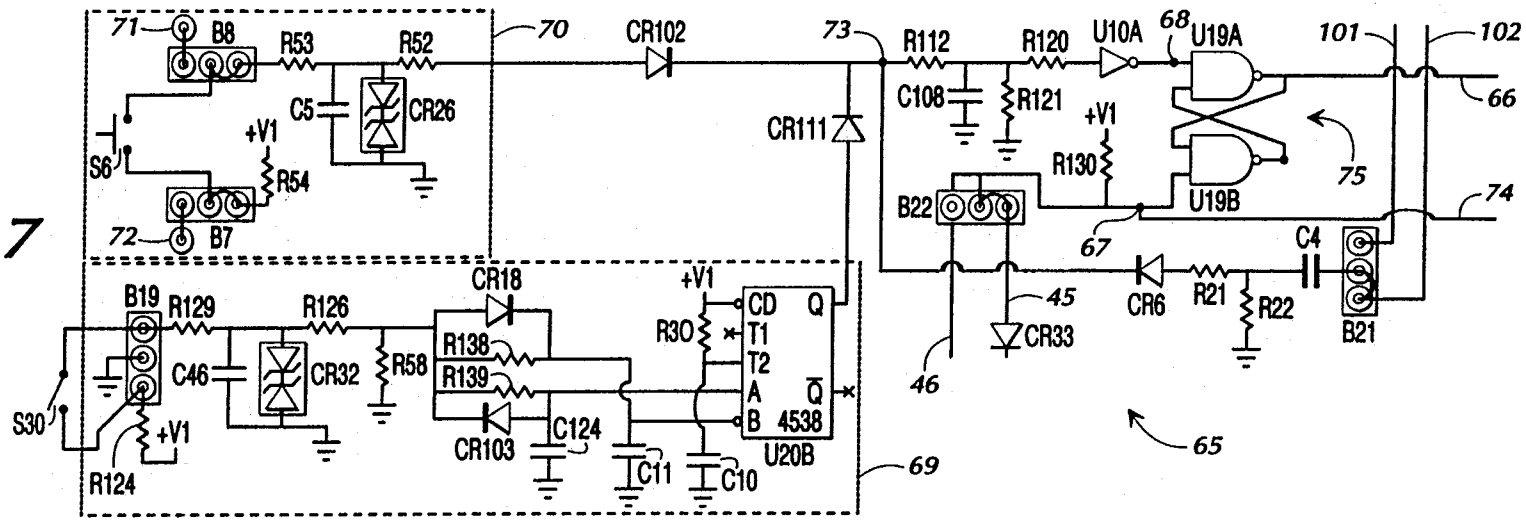
FIG. 7 is a schematic representation of the call-/match circuit shown in FIG. 2.

FIG. 7 is a schematic diagram of call/match circuit 65 shown in block diagram form in FIG. 2. Call/match FF 75 is seen providing output to the call/match output line 66. By providing a low to call/match FF set 68, call/match FF 75 is set. A low at call/match FF set 68 corresponds to a high at wired OR 73 because of inverter U10A connected to call/match FF set 68. Resistors R112, R120, and R121, and capacitor C108 cooperate in providing a noise filter and current limiter for inverter U10A, as well as pulling the input of inverter U10A low until wired OR 73 goes high. Wired OR 73 is connected to three potential sources for a high signal: 1) primary call circuit 70 through diode CR102, 2) auxiliary call circuit 69 through diode CR111, and 3) either all-code flag line 101 or match-code flag line 102 connected through diode CR6.

Primary call circuit 70 contains switch S6 which corresponds to the "PUSH TO CALL" button on receiver 12 and shown in FIG. 1B. As momentary switch S6 is closed from a normally open state, +V1 is supplied to wired OR 73 through resistor R54, jumper B7, switch S6, jumper B8, resistors R53 and R52, and diode CR102. Capacitor C5 and TVS CR26 also function in the same noise and transient eliminating manner as previously disclosed. Therefore, as switch S6 is closed, call/match FF 75 is set, providing a high on call/match output line 66.

Auxiliary call circuit 69 includes switch S30 which corresponds to the "EMERGENCY PULL CORD" switch on receiver 12 and shown in FIG. 1C. This alternate exterior 20 shown in FIG. 1C accommodates the need for a pull cord type switch as opposed to a manual call button, and consequently switch S6 is shown labeling "DAILY CHECK IN". Referring back to the above discussion about manual reset circuit 40 and to FIG. 6, switch S5 is used to indicate a daily check in and is interpreted as such when no call/match detection information immediately precedes such an indication. When a pull cord is chosen to indicate a manual call to scanner 11, the alternate exterior 20 shown in FIG. 1C is used, along with an alternate setting of jumpers B7 and B8. Points 71 and 72 seen on FIG. 6 correspond to points 71 and 72 on FIG. 7. When this alternate receiver exterior 20 shown in FIG. 1C is utilized, jumpers B7 and B8 are configured oppositely to that shown in FIG. 7 to redirect the effect of switch S6 to manual reset circuit 40. Both switch S5 and switch S6 then perform similar functions, but call switch S30 is then used to set call/match FF 75. Of course, in an environment where both a pull cord switch S30 and call button S6 were desired, jumpers B7 and B8 and receiver 20 would be able to remain in a consistent configuration.

Auxiliary call circuit 69 is considered to be a unique toggle switch device. Pull cord switch S30 is often a toggle switch which toggles between an open and a closed position during each pull of the cord. Without the benefit of a momentary switch, the problem of sensing both the closing of a toggle switch and the opening of the same toggle switch to generate a momentary pulse is created. A normal method of solving this problem would be to use two single shot generators, one to sense a rise in voltage, and the other to sense the fall, and both chips connected to the same output point and generating the same momentary pulse. Auxiliary call circuit 69 solves the same problem with only one single shot generator. The effect of auxiliary call circuit 69 is to output a single shot pulse signal through diode CR111 to wired OR 73, which sets call/match FF 75. This pulse is only high for a predetermined amount of time and is generated regardless of whether toggle switch S30 is closing or opening.

The first part of auxiliary circuit 69, including resistors R124, R129, and R126, capacitor C46, and TVS CR32, function substantially similarly to primary call circuit 70. Resistor R30 and capacitor C10 determine the output pulse width. Capacitors C11 and C124, resistors R138 and R139, and diodes CR18 and CR103 all cooperate to provide a unique resistor/capacitor/diode network which, when combined with single shot generator U20B and the first part of auxiliary call circuit 69, create a unique toggle switch device. A rise in voltage on input "A" of single shot generator U20B while input "B" is held high, triggers an output on "Q"; a drop in voltage on input "B" while input "A" is held low triggers an output on "Q". The unique resistor/capacitor/diode network provides each of those functions in response to the toggling of switch S30.

A third input to call/match circuit 65 addresses the "match" portion of call/match circuit 65. All-code flag line 101 and match-code flag line 102 are received from R.F. code circuit 100 and indicate the results of evaluations made by R.F. code circuit 100 with respect to an R.F. code received. A signal on all-code flag line 101 indicates that the code received was a code in the correct format, thus it came from a personal transmitter 15. Match-code flag line 102 indicates that the comparison made between the code received by receiver 12 and a unique code pre-assigned to that particular receiver 12 was favorable; ie, the personal transmitter 15 that transmitted the code is assigned to that particular receiver 12. These signals are received at jumper B21 which is used to configure call/match circuit 65 to respond to either all-code flag line 101 or match-code flag line 102. In the configuration shown in FIG. 7, match-code flag line 102 is used, the "match" part of call/match circuit 65. Because match-code flag line 102 may remain high for an inordinate amount of time after a favorable comparison, capacitor C4 and resistor R22 are used to limit the signal to wired OR 73 to a momentary signal. The option provided by jumper B21 to use all-code flag line 101 instead of match-code flag line 102 is useful in a "common area" of the elderly residence application. As is discussed below, call/match output line 66 provides a signal to feedback circuit 80 which provides, in part, audio feedback. For a common area, it would be useful for others in the area to know by virtue of a bell or buzzer that a resident needs assistance, signified by a personal transmitter 15 transmission. By sensing a signal on all-code flag line 101, call/match FF 75 provides an output that signifies a personal transmitter 15 was activated.

Call/match FF reset 67 is seen connected to initial reset line 74 and to manual reset line 46 and 2-count reset line 45 through jumper B22. Resistor R130 is a pull-up resistor connected to +V1 which keeps call/match FF reset 67 high until pulled low by lines 74, 45, or 46. A first option controlled by jumper B22 is to connect call/match FF 75 to 2-count reset line 45. A second option provided by jumper B22 connects call/match FF reset 67 to manual reset line 46 alone, removing the automatic 2-count reset provided by 2-count circuit 160, shown in FIG. 2. With the effect of 2-count circuit 160 removed, a manual reset from manual reset circuit 40 is required to reset call/match FF 75. This feature has an application to receivers 12 which are designated to require a person to manually push a reset button to reset this memory function of receiver 12. By connecting call/match reset 67 directly to manual reset line 46, as opposed to 2-count reset 45, the effect of initial reset circuit 60 is removed; therefore, initial reset line 74 is included to provide initial power-up reset.

Referring back to FIG. 2, feedback circuit 80 is seen attached to call/match output line 66 and acoustic feedback line 44 from manual reset circuit 40 and smoke circuit 50. The general function of feedback circuit 80 is to provide feedback during off-normal condition states. Buzzer holes 84 in FIG. 1B and 1C provide openings for a buzzer to be heard during off-normal states. Light emitting diode CR122, labeled "CALLING" on FIGS. 1B and 1C, provides visual feedback indicating that call/match circuit output line 66, of FIG. 2, is high. A relay, as well as relay outputs, for enabling external feedback devices are also included in feedback circuit 80.

Figure 8:
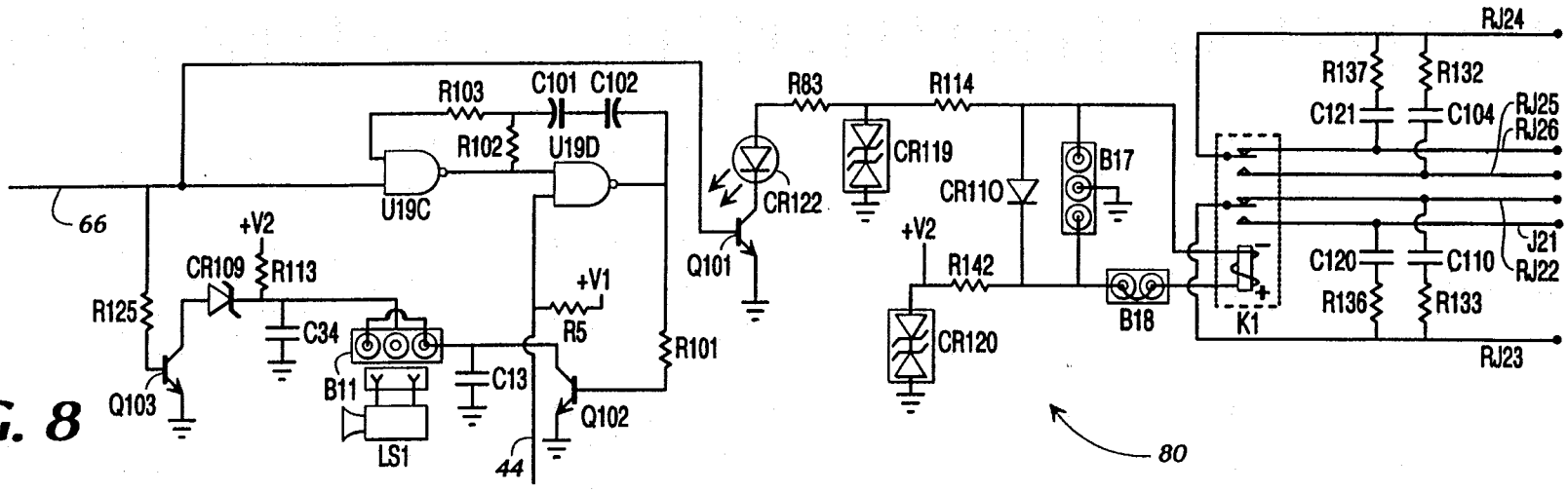
FIG. 8 is a schematic representation of the feedback circuit shown in FIG. 2.

FIG. 8 is a schematic representation of feedback circuit 80 shown in block form in FIG. 2. Call/match output line 66 is seen entering on the left side of FIG. 8. Resistor connects call/match output line 66 to transistor Q103 is turned on when call/match output line 66 goes high. When transistor Q103 is turned on, zener CR109 regulates the voltage to jumper B11 from V2 provided through resistor R113. Capacitor C34 assists in this function. Buzzer LS1 is connected to jumper B11 and sounds when transistor Q102 is turned on. Transistor Q102 is turned on with a high signal on call/match output line 66 or with a low signal on acoustic feedback line 44 from manual reset circuit 40 or smoke circuit 50. Resistor R5 pulls one input of NAND gate U19D up to +V1 normally. A low on acoustic feedback line 44 produces a high on the output of NAND gate U19D which is connected to transistor Q102 through resistor R101 to turn on transistor Q102 and buzzer LS1. A high on call/match output line 66 causes NAND gates U19C and U19D, resistors R103, R102, and R5, and capacitors C101 and C102 to function as a multivibrator as long as call/match output line 66 is high. This multivibrated output is also connected to transistor Q102 and activates buzzer LS1.

Call/match output line 66 is also provided to transistor Q101 which turns on when call/match output line 66 is high to provide a path to ground for light emitting diode CR122 which is connected to +V2 through resistors R83, R114, and R142 and through jumper B17 or the coil of relay K1. Relay K1 provides relay outputs on J21–J26 for external devices, such as lights or sirens. Resistors R137, R132, R136, and R133 and capacitors C121, C104, C120, and C110 are connected as snubbers across relay contacts J21–J26. Jumper B18 is a jumper to disconnect relay K1. Jumper B17 is a jack for an external relay. Diode CR110 and TVS CR119 and CR120 provide protection from dangerous external signals. Diode CR110 protects Q101 from reverse voltage caused by the collapsing field when the relay coil is turned off.

Referring back to FIG. 2, personal transmitter 15 transmits a unique R.F. code when a button on personal transmitter 15 is pushed. R.F. receiver circuit 90 receives that R.F. code and outputs a signal on R.F. output line corresponding to the unique code of the R.F. signal received. R.F. code circuit 100 then evaluates the code received from R.F. receiver circuit 90 to generate signals on all-code flag line 101 and match-code flag line 102, discussed above. Reset/ground code line 47 from manual reset circuit 40 connects to R.F. code circuit 100 to ground R.F. output line 91 when a manual reset has been activated, preventing codes from being evaluated by R.F. code circuit 100. Call/match output line 66 also connects to R.F. code circuit 100 to selectively ground R.F. output line 91 when call/match FF 75, of FIG. 7, is set and when the format of a code received is the correct format. This function corresponds to the match code lock out discussed above. All-code output line 107 is seen connected to 2-count circuit 160 to provide a reset to the counter within 2-count circuit 160, as is discussed above. Latch power/enable line 103, data valid line 104, latch clock line 105, and latch data line 106 are connected to latch/encoder circuit 110 and are each discussed below. Finally, 2-count reset line 45 is connected to R.F. circuit 100 to reset the memory device contained therein.

Figure 9:
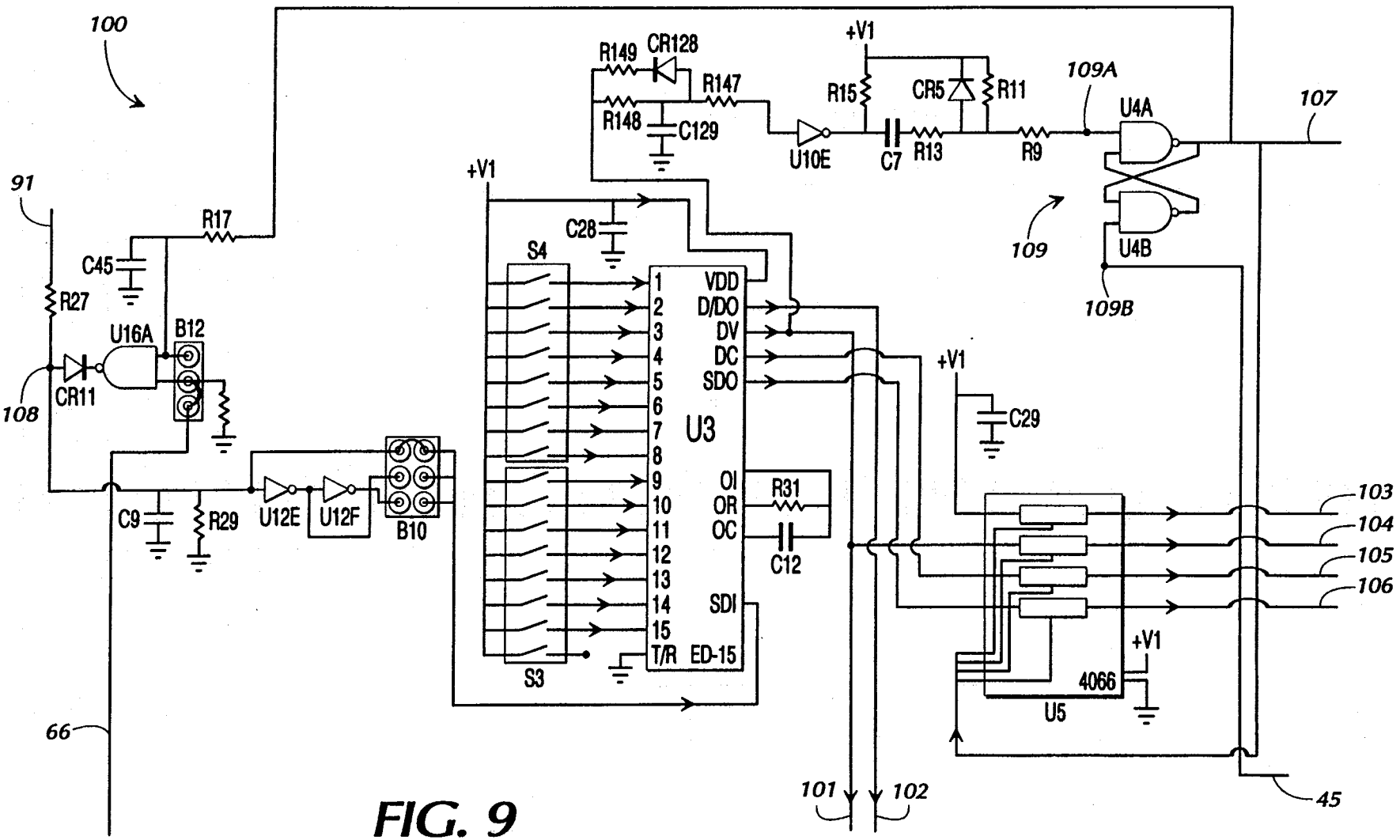
FIG. 9 is a schematic representation of the R.F. code circuit shown in FIG. 2.
Figure 10A:
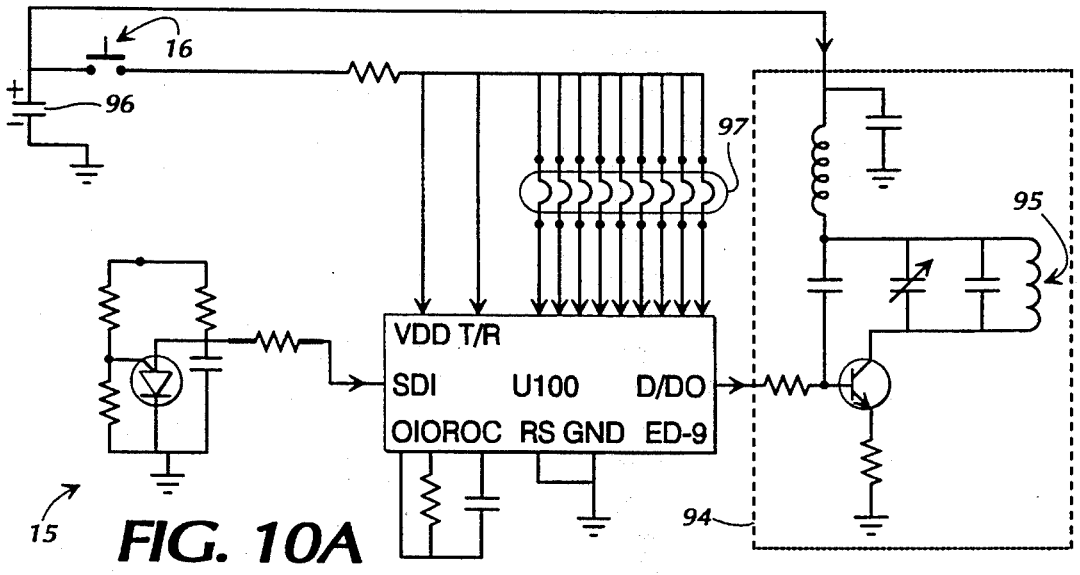
FIG. 10A is a schematic representation of the personal transmitter shown in FIG. 1.
Figure 10B:
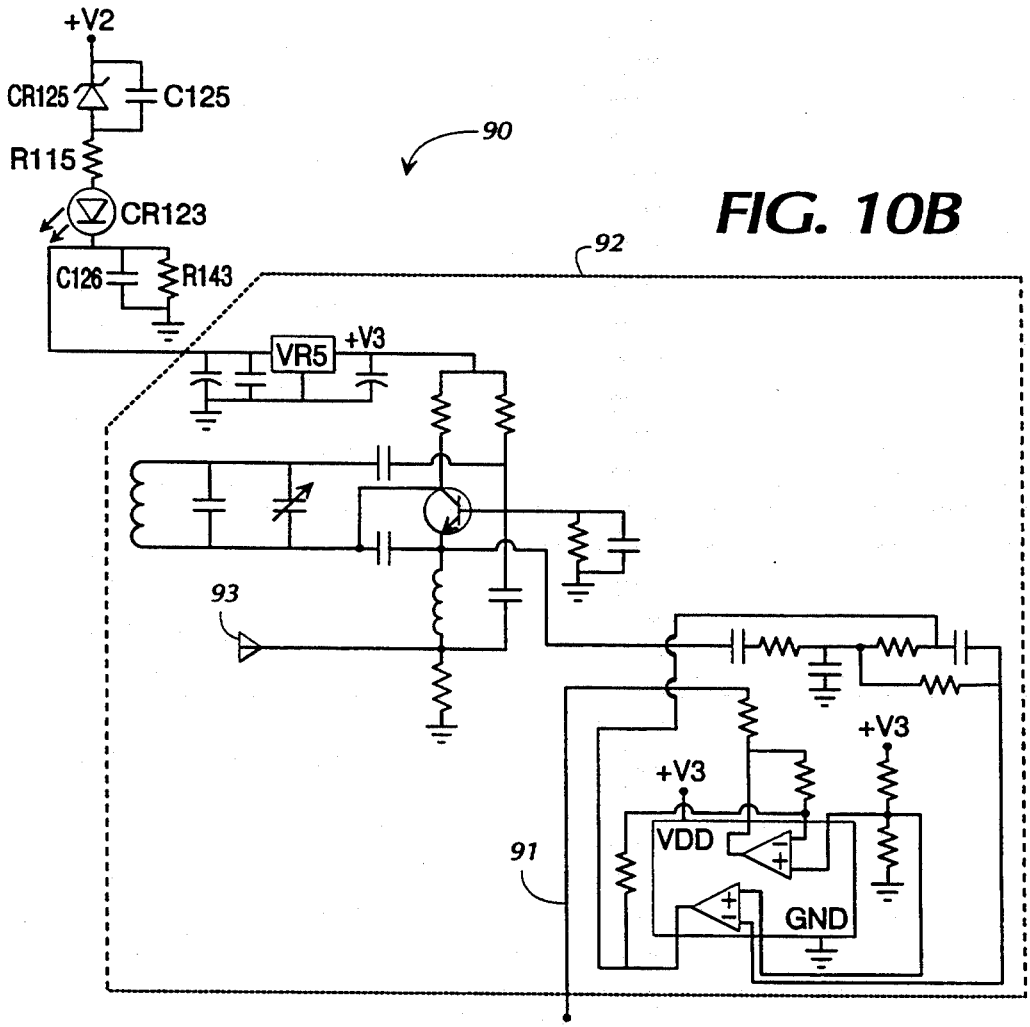
FIG. 10B is a schematic representation of the R.F. receiver circuit shown in FIG. 2.

FIG. 9 is a schematic representation of R.F. code circuit 100 shown in block form in FIG. 2. FIG. 10A is a schematic representation of personal transmitter 15 shown in block form in FIG. 2. FIG. 10B is a schematic representation of R.F. code receiver circuit 90 shown in block form in FIG. 2. Referring to FIG. 10A, momentary transmit button 16 is pressed to supply power from transmitter battery 96 to the rest of personal transmitter 15. U100 functions as an encoder to encode a signal corresponding to transmitter jumpers 97 at a pulse rate determined by circuitry connected to inputs OI, OR, and OC and in a protocol that will be understood by R.F. code circuit 100. One acceptable protocol is the "Manchester encoding scheme". A packet of information is transmitted each time a drop in voltage is supplied to the SDI input by circuitry connected thereto. U100 outputs the encoded information to transmitter circuit 94 which transmits the signal through stripline inductor 95. FIG. 10B is a schematic representation of R.F. receiver circuit 90. +V2 is supplied through voltage limiting zener CR125, resistor R115 and LED CR123 to R.F. receiver main circuit 92. R.F. signals are received from personal transmitter 15 through R.F. receiver antenna 93, and a corresponding coded signal is output on R.F. output line 91 to R.F. code circuit 100.

FIG. 9 shows R.F. output line 91 connected through resistor R27 to point 108 where it can be grounded through diode CR11 as is discussed below. If the coded signal is not blocked at point 108 by being grounded, the coded signal continues optionally through inverters U12E and U12F and jumper B10 to reach coded signal decoder/comparer U3. Capacitor C9, resistor R29, inverters U12E and U12F, and Jumper B10 cooperate to filter variable amounts of noise and signal degradation out of the coded signal. The coded signal is input into decoder/comparer U3 at the SDI input. Resistor R31 and capacitor C12 determine the pulse rate at which decoder/comparer U3 will attempt to decode the signal which matches that of personal transmitter 15. Switches S3 and S4 are dip switches that are configured to the unique code pre-assigned to each particular receiver/transmitter pair. Decoder/comparer U3 decodes the coded signal received in the SDI to first evaluate whether the received coded signal is in the correct format and emits a high signal on the DV output, signifying a data valid. This output is seen connected to all-code flag line 101 which is discussed above.

The DV output is also connected to circuitry leading into radio FF set 109A. Due to R.F. noise concerns, a noise circuit composed of resistors R147, R148, & R149, capacitor 129, and diode CR128 are included to improve data valid signal integrity. In the preferred embodiment, personal transmitter 15 emits discrete code blocks lasting approximately 20 milli-seconds separated by gaps lasting approximately 100 milli-seconds while momentary transmit button 16 is pressed. The DV output of decoder/comparer U3 normally remains high until another code block begins to be received. If noise is not interfering with the SDI input to decoder/comparer U3, a constant gap between code blocks will ensure that the DV output remains high for a constant amount time. The above referenced noise circuit takes advantage of this constant gap and imposes a slow rise and a fast fall on the DV output. Through appropriate component value relationships, noise is prevented from affecting the input to inverter U10E. This noise circuit is considered important to the present invention.

As inverter U10E inverts the signal, capacitor C7 at first acts like a short and produces a low to radio FF set 109A as the signal goes through resistors R13 and R9. This low sets radio FF 109 to produce a high on all-code output line 107. As capacitor C7 charges through resistors R11 and R13, the radio FF set 109A goes back to a high, making radio FF 109 vulnerable to being reset by 2-count reset line 45. This function in necessary because DV remains high until the beginning of the next coded signal received on the SDI input. When the signal from DV is removed from the input of inverter U10E, diode CR5 shorts capacitor C7 to prevent a harmful negative pulse from proceeding to radio FF 109. Along with the data valid signal from the DV output, two other outputs are connected to quad-transmission gate U5, a clock pulse from the DC output and serial data from the SDO output which corresponds to the code transmitted by any personal transmitter 15 within range of receiver 12. These three lines and a +V1 power line are gated through quad-transmission gate U5 as long as all-code output line 107 is high. These signals are then output onto lines latch power/enable line 103, data valid line 104, latch clock line 105, and latch data line 106 which are connected to latch encoder circuit 110. Capacitor C29 and C28 are seen connected to +V1 and ground at the inputs to U3 and U5. If not specifically designated on each chip represented in the remaining FIGS., a capacitor of this type is connected across each power supply chip input for +V1 noise filtering. Also, it is important to note that any inputs of any portions of chips left over and not used by circuitry shown the FIGS. are appropriately tied high or low to prevent damage to the chips.

Now, concerning the R.F. output line 91 grounding functions. As discussed above, a lock-out function from previously received coded signals is provided to prevent loss of the first signal. Reset/ground code line 47 is seen connected directly to R.F. output line 91 at point 108 to provide the manual reset grounding effect. NAND gate U16A cooperates with Jumper B12 to provide the lock-out option. A first option would of course be to simply provide no connections across B12 and disable the lock-out function, allowing every new signal received by R.F. receiver circuit to replace existing signals. A second option is the configuration of jumper B12 shown in FIG. 9. This is the match code lock-out. When all-code output line 107 goes high, that signal is supplied through resistor R17 to NAND gate U16A. If the coded signal received matched the pre-assigned unique code as designated by dip switches S3 and S4, the D/DO output of decoder/comparer U3 outputs a high on match-code flag line 102 which, if connected properly to call/match circuit 65, causes a high to appear on call/match output line 66, connected to the other input of NAND gate U16A. When both of these signals go high, indicating that a code was received that matched the pre-assigned unique code, R.F. output line 91 is grounded through diode CR11, preventing signals from entering decoder/comparer U3. With B12 configured for the third option, NAND gate U16A is used is simply as an inverter to ground R.F. output line 91 whenever all-code output line 107 goes high, essentially locking out all signals after the first coded signal is received. Resistor R17 and capacitor C45 cooperate to delay the signal from all-code output line 107 to NAND gate U16A. This delay provides time for several samples of the coded signal to be received by decoder/comparer U3 before the input is grounded.

Referring back to FIG. 2, latch/encoder circuit 110 is connected to R.F. code circuit 100 along lines 103–106 previously mentioned. Outputs from memory devices previously discussed are also connected, including auxiliary output line 31, smoke output line 51, and manual reset output line 41, and call/match output line 66. As a momentary signal is received from single pulse circuit 150 along single pulse line 151, latch/encoder circuit 110 outputs along code output line 112 and inverted code output line 111 a receiver output packet, encoded from the inputs to latch/encoder circuit 110, to output driver circuit 120.

Figure 11:
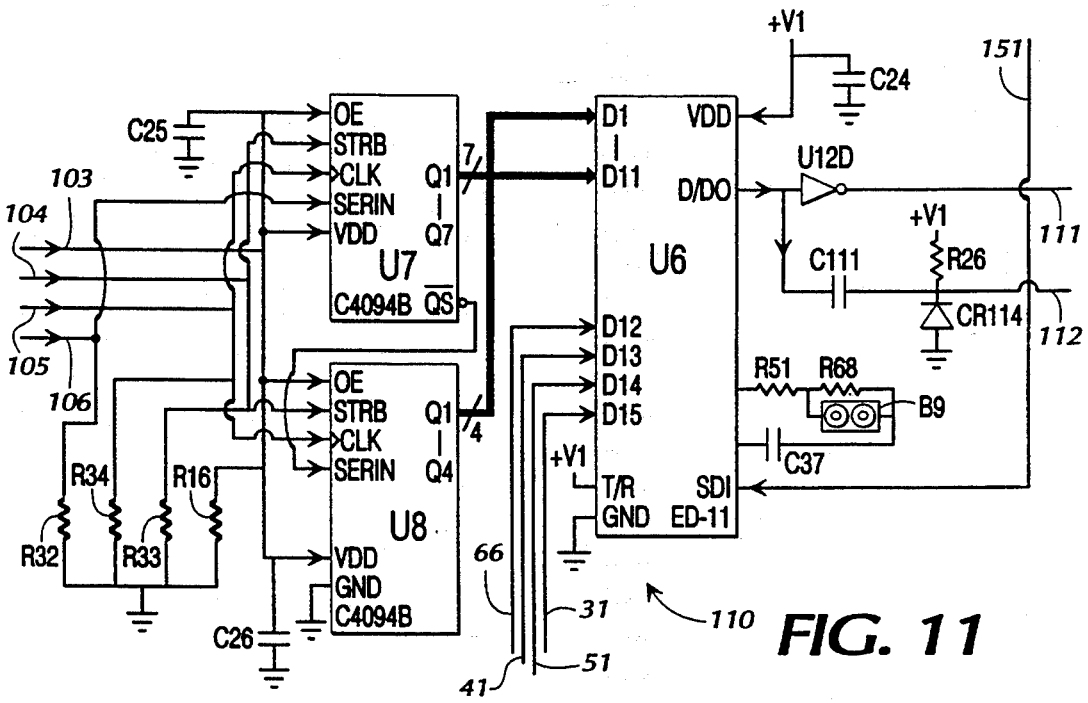
FIG. 11 is a schematic representation of the latch/encoder circuit shown in FIG. 2.

FIG. 11 is a schematic representation of latch/encoder circuit 110 shown/in block form in FIG. 2. Serial to parallel latches U7 and U8 are used to latch and convert serial data received over latch data line 106 from R.F. code circuit 100 to parallel outputs which run from Q1–Q7 of U7 and Q1–Q4 of U8 to encoder U6. Lines 66, 41, 51 and 31 are also seen running into U6. In order to clear latches U7 and U8, +V1 is removed from the VDD inputs. However, because the latches are not designed to receive signals on the inputs when +V1 is not provided to VDD, all input signals including +V1 are gated through quad-transmission gate U5 previously discussed in conjunction with FIG. 9. Resistors R32, R34, R33 and R16 are used to pull the input leads low until signals are received on lines 103–106. Capacitors C25, C26, and C24 are connected to VDD inputs as previously mentioned. Resistors R51 and R68 cooperate with capacitor C37 and jumper B9 to provide a variable pulse rate for output from D/DO of encoder U5. This option is discussed below. The receiver output packet is supplied out of D/DO output when a falling edge is sensed on SDI input from single pulse line 151. The receiver output packet is supplied through inverter U12D to inverted code output line 111 and through capacitor C111 to code output line 112. Capacitor C111, resistor R26 and diode CR114 cooperate to pass the receiver output packet, but to produce a steady state high on code output line 112 to conserve power. This function is discussed in detail below.

Referring back to FIG. 2, output driver circuit 120 is seen connected to latch/encoder circuit 110 along code output line 112 and inverted code output line 111. Single pulse line 151 also connects output driver circuit 120 to single pulse circuit 150. As a momentary pulse is received along single pulse line 151, the receiver output packet received from latch/encoder circuit 110 is driven onto receiver output lines J15 and J16, which are part of communication link 18, to scanner 11. Output line J14 is connected to ground.

Figure 12:
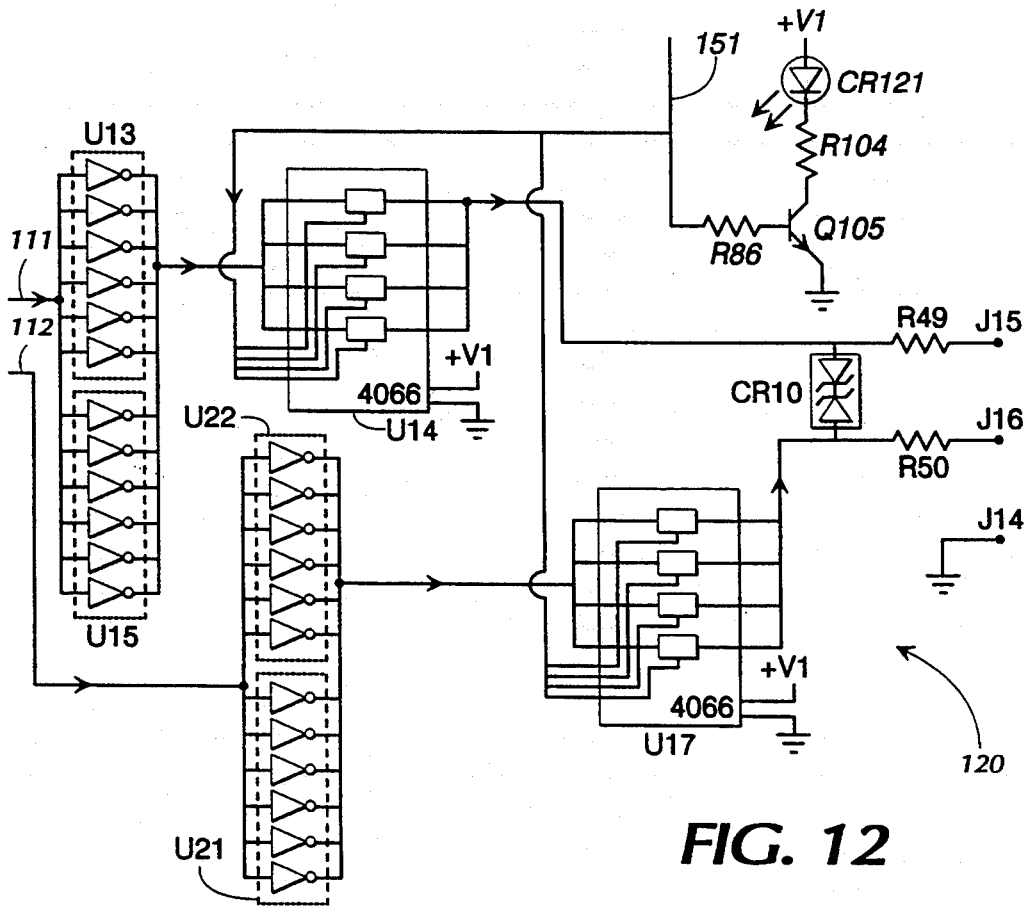
FIG. 12 is a schematic representation of the receiver output driver circuit shown in FIG. 2.

FIG. 12 is a schematic representation of output driver circuit 120 shown in block form in FIG. 2. The conventional method for driving receiver output packet onto output lines J15 and J16 back to scanner 11 would be to use a voltage driver IC. However, because in one application, power is supplied from scanner 11 to every receiver 12, power consumption is a major factor. A voltage driver IC in every receiver would draw too much steady state current because voltage driver IC's normally require power continuously, regardless of whether signals are being drive. A unique method of driving receiver output packet which requires very little power is shown In FIG. 12. CMOS inverters U13, U15, U22 and U21 are used to sink and source a large enough current to transmit the receiver output packet. Because these inverters are CMOS, they only require power during the pulse transitions. Furthermore, the momentary pulse on single pulse line 151 is used in conjunction with quad-transition gates U14 and U17 to limit the time which inverters U13, U15, U21, and U22 are actively connected to output lines J15 and J16. Also, as discussed above, code output line 112 and inverted code output line 111 are kept high during steady state conditions. The outputs of inverters U13, U15, U21, and U22 are therefore kept low. Both the fact that single pulse line 151 carries a momentary pulse and that lines 111 and 112 are kept high cooperate with CMOS inverters U13, U15, U21, and U22 to provide a unique balanced system output driver. Resistors R49 and R50 along with TVS CR10 guard the circuit against high energy transients, such as lightning. Also, resistors R86 and R104, transistor Q105, and LED CR121 cooperate to turn on LED CR121 during the momentary pulse on single pulse line 151. LED CR121 is also seen in FIGS. 1B and 1C as the "TESTING" indicator to indicate that receiver 12 is being polled.

Referring back to FIG. 2, input driver circuit 130 is seen connected to receiver input lines J11, J12, and J13, which are part of communication link 18. Polling data is received from scanner 11 along lines J11 and J12. Line J13 is simply connected to ground. Input driver circuit 130 purifies the balanced system signals received on receiver input lines J11 and J12 and supplies that purified data to address compare circuit 140 along receiver input driver output line 131.

Figure 13:
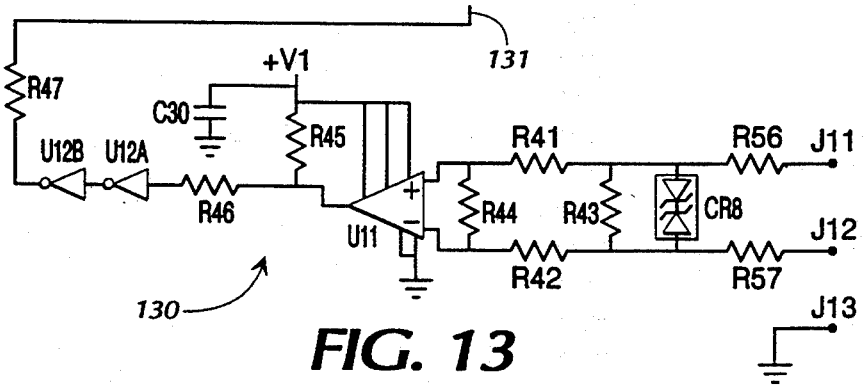
FIG. 13 is a schematic representation of the receiver input driver circuit shown in FIG. 2.

FIG. 13 is schematic representation of input driver circuit 130 shown in block form in FIG. 2. The balanced signals received on receiver input lines J11 and J12 are supplied to high gain comparator U11 through amplitude reducing resistors R41 and R42. Resistors R44 an R43 stabilize the signals, and resistors R56 and R57 cooperate with TVS CR8 to protect the circuit from high energy transients such as lightning. High gain comparator U11, in cooperation with resistor R45 and capacitor C30, produces a single output line to resistor R46 which limits the current to inverters U12A and U12B operating as Schmitt triggers to further purify the signals of information as they are output through resistor R47 along receiver input driver output line 131.

Referring back to FIG. 2, address compare circuit 140 is seen connected to receiver input driver circuit 130 along receiver input driver output line 131 to receive the purified signals of information from scanner 11. Address compare circuit 140 compares the address contained within the signals to a pre-assigned address that is unique to each receiver 12. An indication of the result of that comparison in sent to single pulse circuit 150 along compare output line 141.

Figure 14:
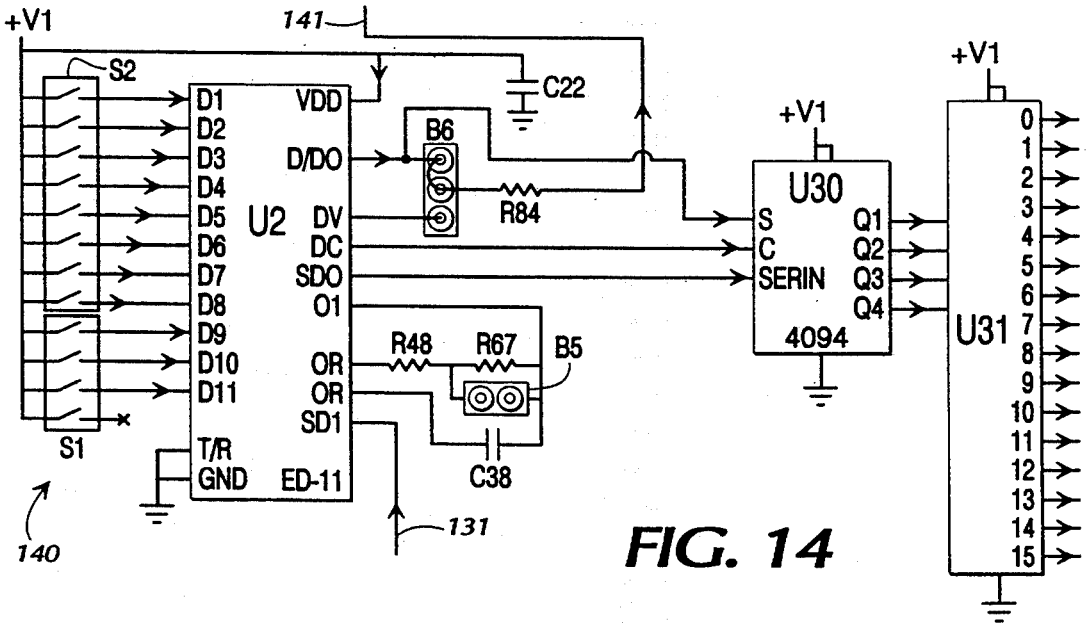
FIG. 14 is a schematic representation of the address compare circuit shown in FIG. 2.

FIG. 14 is a schematic representation of address compare circuit 140 shown in block form in FIG. 2. Address decoder/comparer U2 functions very similarly to R.F. code decoder/comparer U3 of R.F. code circuit 100 shown in FIG. 9. Input to address decoder/comparer U2 is received along receiver input driver output line 131 into the SDI input and decoded. A unique address is assigned to each receiver 12 through dip switches S1 and S2 shown connected to +V1 and D1–D11. As shown in FIG. 14, 15 bits, 11 for receiver 12 address and 4 for data from scanner 12, can be decoded. It should be understood that this is only one acceptable example of the number of bits which could be used to designate addresses. The first 11 bits of each group of signals received from scanner 11 through receiver driver input circuit 130 is compared to the unique address designated by dip switches S1 and S2. The results of the comparisons are provided to compare output line 141 from the D/DO output of address decoder/comparer U2. This output remains high until another group of signals is received from scanner 11. Resistors R48 and R67, jumper B5, and capacitor C38 also function similarly to their equivalents in R.F. code circuit 100, and are also discussed in detail below. Jumper B6 provides a testing option of connecting compare output line to the DV output which goes high after every group of signals that matches the correct format is received. This function allow a receiver to be set to respond to every polling by a scanner 11 for testing purposes. Serial to parallel/latch U30 has is strobe, clock, and serial-data-in respectively connected to the data out (DO), data clock (DC), and serial-data-out (SDO) of address decoder/comparer U2. The Q1–Q4 binary outputs of U30 can be used directly to control four separate functions or can be connected to binary-to-hex converter U31 as shown to provide 16 functions. Alternately, a binary-to-decimal converter could be used to provide 10 functions. The effects of the commands could easily be sent back to scanner 11 for verification or other processing through the data inputs of encoder U6 seen in FIG. 11.

Referring back to FIG. 2, single pulse circuit 150 is seen connected to address compare circuit 140 through compare output line 141 to receive notification that a favorable comparison was made with respect to the group of signals received from scanner 11; ie, that particular receiver is being polled by scanner 11. Because compare output line 141 would remain high until another group of signals is received from scanner 11, a problem which prevents the next group of signals from being received by receiver 12, would keep compare output line 141 high for an inordinate amount of time. If some method of limiting this time were not included, the receiver output driver circuit could continue to supply a DC level onto communication link 18, not a desirable possibility. Therefore, single pulse circuit 150 is used to generate a momentary pulse on single pulse line 151 to latch/encoder circuit 110 and output driver circuit 120 and an inverted version of that momentary pulse on inverted single pulse line 152 to 2-count circuit 160.

Figure 15:
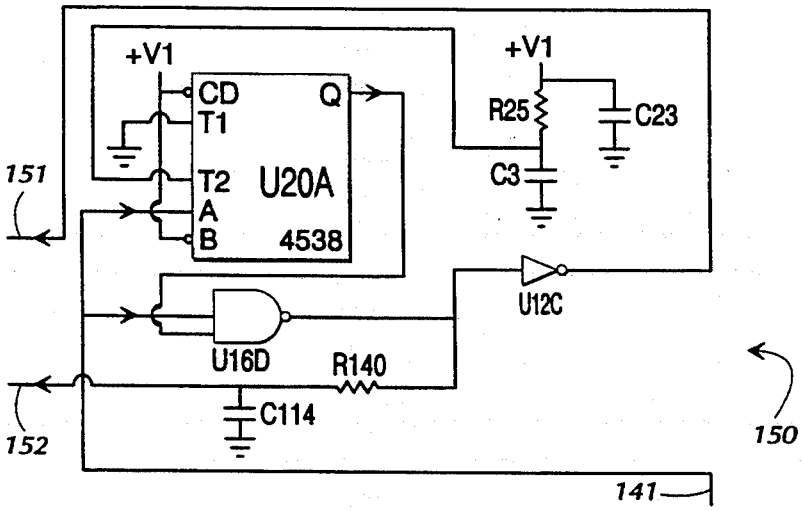
FIG. 15 is a schematic representation of the single pulse circuit shown in FIG. 2.

FIG. 15 is a schematic representation of single pulse circuit 150 shown in block diagram in FIG. 2. Compare output line 141 is seen connected to single shot generator U20A which detects a rise in voltage on input "A" while input "B" is held high to generate a momentary pulse on output "Q", whose duration is determined by capacitor C3 and resistor R25. Capacitor C23 is the customary +V1 capacitor to ground for each IC. Output "Q" and compare output line 141 are connected to NAND gate U16D to produce the inverted momentary pulse on inverted pulse line 152 through noise reducing resistor R140 and capacitor C114. Inverter U12C supplies the momentary pulse to single pulse line 151.

Referring back to FIG. 2, 2-count circuit 160 is seen connected to single pulse circuit 150 through inverted single pulse line 152. Five input lines are seen connected to 2-count circuit 160 from R.F. code circuit 100, call-/match circuit 65, manual reset circuit 40, smoke circuit 50, and auxiliary circuit 30. 2-count reset line 45 is also seen connected to 2-count circuit 160. After receiver 12 is polled twice without any changes in monitored conditions, a 2-count reset signal is generated on 2-count reset line 45. However, if an off-normal condition is detected before a second polling, 2-count circuit 160 will be reset to start the count again. This 2-count feature increases data integrity by ensuring that two pollings of a receiver 12 are made before memory devices are reset.

Figure 16:
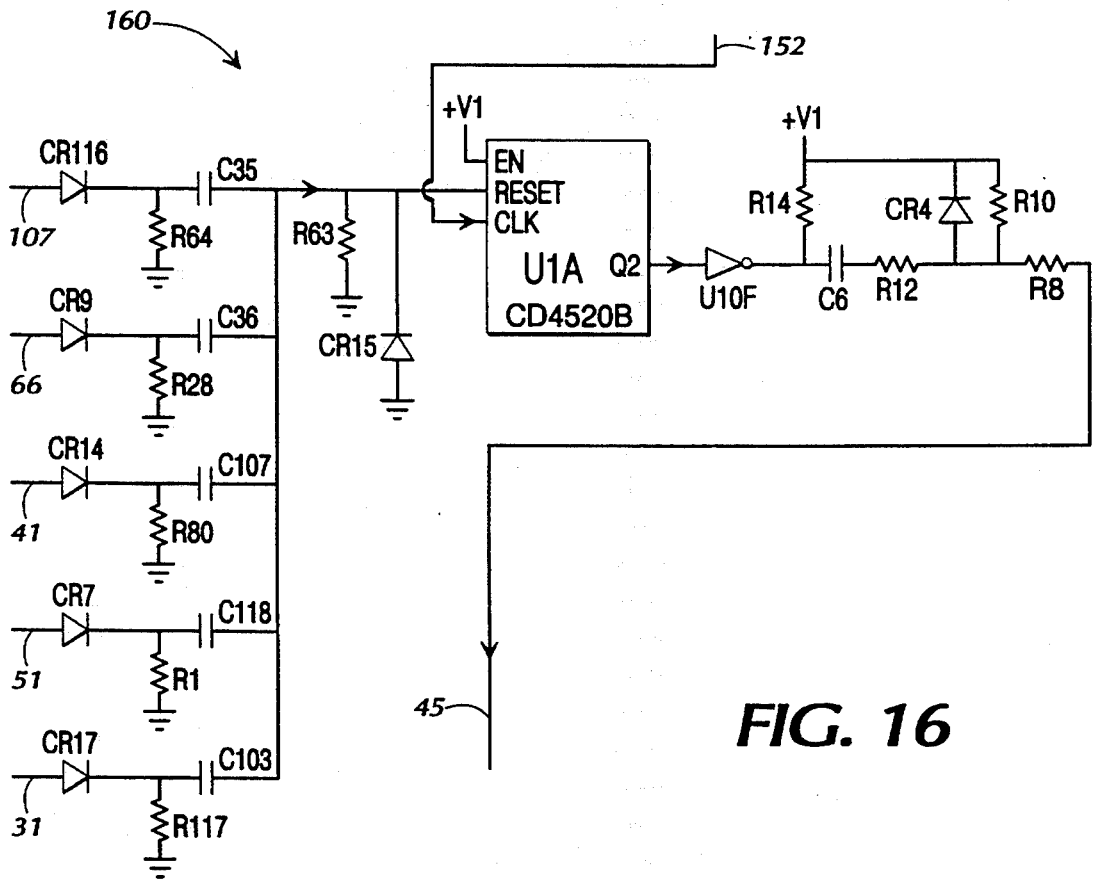
FIG. 16 is a schematic representation of the 2 count circuit shown in FIG. 2.

FIG. 16 is a schematic representation of 2-count circuit 160 shown in block form in FIG. 2. An inverted pulse is received on inverted single pulse line 152 by counter U1A. As the inverted pulse rises back to a high, providing time for the receiver data packet to be sent to scanner 11, U1A counts the rise in voltage as the first count. Then, if no new signals are sent in on lines 107, 66, 41, 51, or 31 before the next polling, the next rise of the next inverted momentary pulse from single pulse circuit 150 produces a rise on Q2 of counter U1A. That high makes its way through the connecting circuit to be output as a momentary low pulse on 2-count reset line 45. The circuit connected to Q2 functions in a generally similar manner to the corresponding circuit in FIG. 9. The diode/capacitor/resistor network connecting inputs 107–31 to the reset input of counter U1A limit the signals received along those lines to momentary pulses and isolate each from the other to provide an efficient reset signal to counter U1A. Resistor R63 keeps the reset input low until one of the input lines goes high, and diode CR15 shorts harmful negative capacitor-generated pulses.

Figure 17:
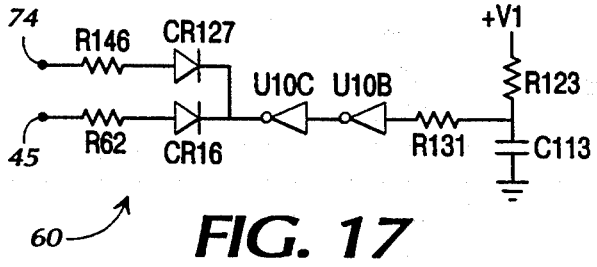
FIG. 17 is a schematic representation of the initial reset circuit shown in FIG. 2.

Referring back to FIG. 2, initial reset circuit 60 is seen connected to 2-count reset line 45 and to call-/match circuit 65 along initial reset line 74. Initial reset circuit 60 provides a momentary low to 2-count reset line 45 and to initial reset line 74 for an initial time period after power is supplied to receiver 12. FIG. 17 shows a schematic representation of initial reset circuit 60 shown in block form in FIG. 2. Initially, capacitor C113 acts like a short circuit to ground, which grounds the input of inverter U10B through current limiting resistor R131. Inverters U10B and U10C supply this low to a wired OR at the connection of diodes CR127 and CR16. These diodes and resistors R146 and R62 function in the previously disclosed wired OR manner to supply lows to both 2-count reset line 45 and initial reset line 74. After an initial period of time, capacitor C113 charges through resistor R123 from the +V1 source and removes the ground to inverter gate U10B.

Referring back to FIG. 2, receiver power supply circuit 165 receives +V2 power from receiver power input lines J17 and J18, two lines included in communication link 18, shown in FIG. 1. Alternately, +V2 could be supplied to lines J17 and J18 at each remote area, separate from communication link 18. Also, receiver power supply circuit 165 is designed to handle both AC and DC sources. +V1, +V2 and ground are provided for all other circuits within receiver 12 from receiver power supply circuit 165. A unique feature of receiver power supply circuit 165 concerns a combination of the preceding functions and the ability to connect a DC power supply ground provided over J17 to the logic ground while guarding against the harmful affects of accidentally connecting AC during this mode. This feature is discussed more fully below.

Figure 18:
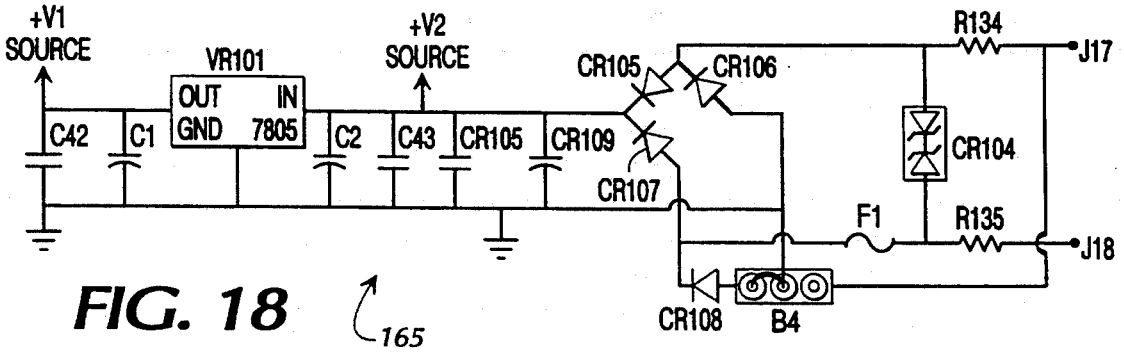
FIG. 18 is a schematic representation of the receiver power supply circuit shown in FIG. 2.

FIG. 18 shows a schematic representation of receiver power supply circuit 165 shown in block form in FIG. 2. +V2 is supplied to lines J17 and J18. Resistors R134 and R135 cooperate with TVS CR104 to block the dangerous effects of high energy transient signals, such as lightning, from the rest of receiver 12. Fuse F1 offers additional surge protection. With jumper B4 connected as shown, the diode network of CR105–CR108 is connected in the standard full-wave rectifier configuration. Capacitors C109, C2, and C105 filter low, medium, and high frequencies from the output of the diode network. +V2 is available for other receiver 12 circuits from the output of the diode network and is connected to voltage regulator VR101 which is used to supply +V1 to other receiver 12 circuits. Capacitors C43, C1, and C42 all cooperate with VR101 to provide a non-oscillating +V1 source.

The cooperation between jumper B4 and the diode network of diodes CR105–CR106 is considered unique. Jumper B4 provides two modes of operation. The first mode, an "AC" mode, is shown in FIG. 18. This "AC" mode accommodates both an AC source and a DC source where positive and negative terminals of the source can be interchanged on lines J17 and J18 without causing any harm to the circuit. The second mode, a "DC" mode, offers the feature of being able to connect a DC power supply ground to the logic ground for better noise protection and signal clarity, which becomes a greater factor as the distance between receivers 12 and scanner 11 increases. This option is provided through a method that also protects the circuit from an accidental connection to an AC source while jumper B4 is configured for this second "DC" mode. This feature is considered unique. If one were to take a full wave rectifier and merely short out a diode in the network, the power supply ground could indeed be connected to the logic ground. However, if this were the only condition changed, a backwards DC connection or the bottom of an AC cycle would be very harmful because another of the diodes would be forced to conduct all of the current, bypassing the load and causing damage to any components in this shorted, high-current path.

The method of the present invention gives the advantage of common grounds, while avoiding any harmful effects of an accidental AC or reversed DC connection. Line J18 is defined as the positive input line, and line J17 is defined as the negative input line. With jumper B4 connected alternately to that seen in FIG. 18, the "DC" mode is selected. A positive signal on J18 would flow through resistor R135, diode CR107, through the effective load of receiver 12, and back through jumper B4 to line J17. J17 is then connected directly to the logic ground of receiver 12. However, an accidental reversal of lines J17 and J18 with a DC source, or an accidental connection to AC, would not be harmful. No valid current path exists from J17 to J18 when jumper B4 is in the "DC" mode. This is considered to be a very unique function of the present invention.

SCANNER DESCRIPTION:

Referring back to the preferred embodiment of the present invention shown in FIG. 1, scanner 11 is seen connected to receivers 12 through communication links 18. +V2 external power line 24, including links P11 and P12, connect scanner 11 to DC power supply 25. Also, +V1 can be supplied to scanner 11 from controller 19 through links P1 and P3. RS-232 link 23, including scanner transmit link P22, scanner receive link P23, ground link P25, and +V2 power sample link P26, also connect scanner 11 to controller 19.

Figure 3:
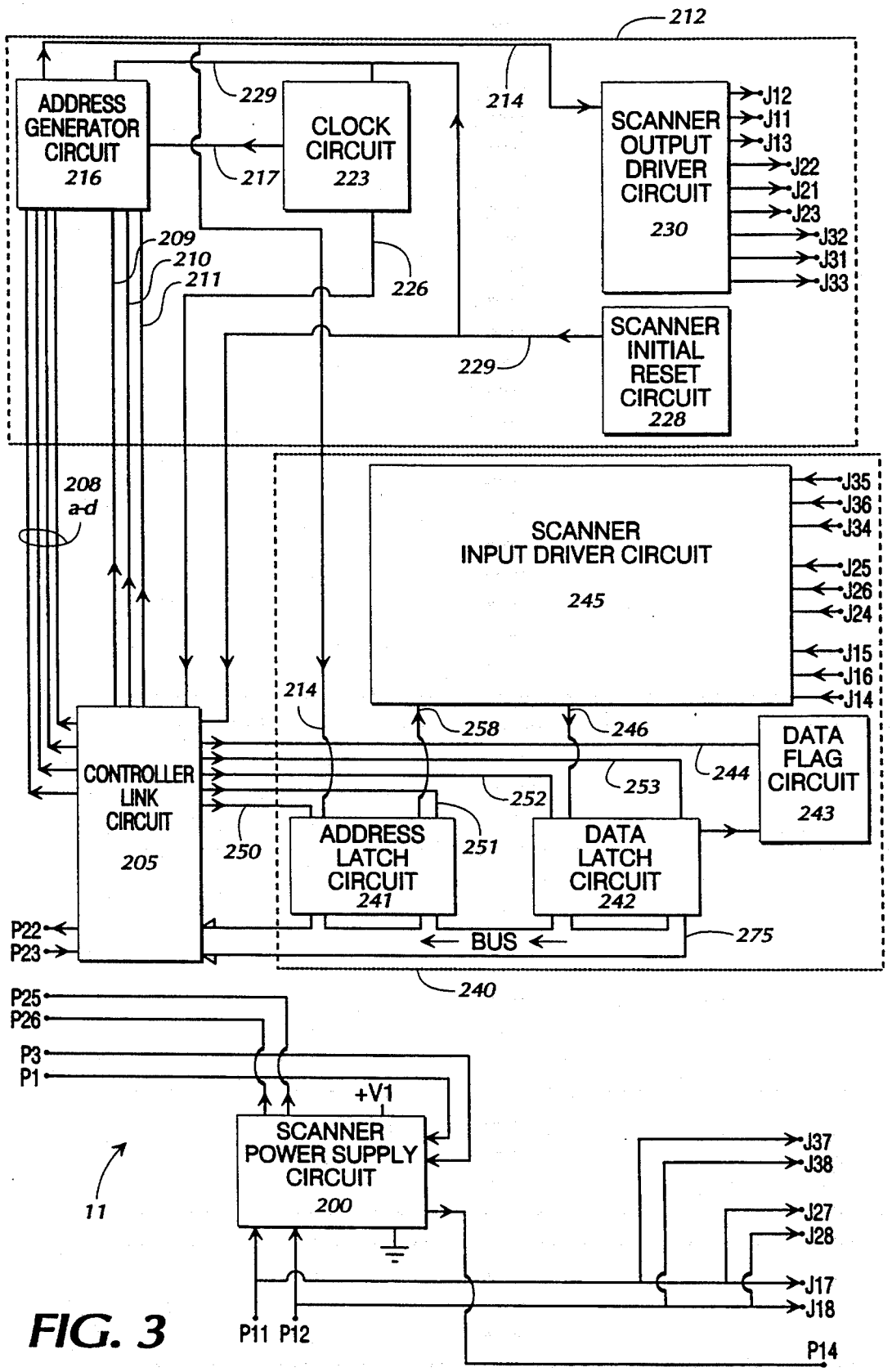
FIG. 3 is block diagram representation of a preferred embodiment of the scanner shown in FIG. 1.

Referring now, and throughout this discussion, to FIG. 3, scanner 11 is shown in greater detail along with the same connecting links shown in FIG. 1. Briefly described, scanner 11 includes four main sections, delineated by dotted lines. These four sections include scanner power supply circuit 200, controller link circuit 205, address generator circuit 212, and bus circuit 240. Power supply circuit 200 functions in a substantially similar manner to receiver power supply circuit 165, shown in FIG. 18 and discussed above. In addition to the common ground capability discussed above, an option for using the +V1 source in controller 19 through links P1 and P3, instead of converting +V2 to +V1, is included in scanner power supply circuit 200. (References to items not included in specific drawings are shown in FIG. 1 and/or FIG. 3.)

Controller link circuit 205 provides a communication interface with controller 19. Serial data signals are transmitted from scanner 11 to controller 19 on scanner transmit link P22 and received by scanner 11 from controller 19 on scanner receive link P23.

Address generator circuit 212 includes scanner initial reset circuit 228, scanner output driver circuit 230, clock circuit 223, and address generator circuit 216. Scanner initial reset circuit 228 supplies reset signals during power-up through scanner initial reset line 229 to controller link circuit 205, address generator circuit 216, and clock circuit 223. Clock circuit 223 contains a crystal and a counter which generates clock pulses at various selectable rates. Pulses at different rates are supplied to address generator circuit 216 over free run control line 217 and to controller link circuit 205 over baud rate line 226. Scanner output driver circuit 230 receives receiver-bound, encoded address signals from address generator circuit 216 over encoder output line 214 and drives those signals simultaneously over all connected receiver transmit links, including, but not limited to, J11–J13, J21–J23, J31–J33.

Address generator circuit 216 contains an address counter to generate addresses, an encoder to encode the addresses, and related circuitry. In a normal operating mode, the address counter is controlled by controller 19 through controller link circuit 205 over address counter increment line 210 and address counter reset line 209. A signal from controller 19 through controller link circuit 205 over manual send data line 211 instructs the encoder located in address generator circuit 216 to output an encoded address signal along encoder output line 214. This encoded address signal is supplied to scanner output driver circuit 230, as discussed above, and to bus circuit 240 to be communicated back to controller 19. In a free running test mode, clock circuit 223 controls both the address counter and encoder located in address generator circuit 216 over free run control line 217. Also, command signals from controller 19 may be directed through controller link circuit 205 through receiver command lines **208*a–d* to address generator circuit 216** to be encoded along with the address signals. Further references to encoded address signals are considered to also include these optional command signals.

Bus circuit 240 drives data along bus 275 to controller link circuit 205 to be transmitted to controller 19 through scanner transmitter link P22. As previously mentioned, the encoded address signals sent along encoder output line 214 are also supplied to bus circuit 240. These signals are decoded and stored in address latch circuit 241. Encoded receiver data is received through scanner input driver circuit 245 and supplied to data latch circuit 242 over scanner input driver output line 246. Data latch circuit 242 decodes and stores this data and provides a data-received signal to data flag circuit 243. Data flag circuit 243 then provides a corresponding signal along data flag output line 244 to controller link circuit 205. Controller 19 responds by sequentially enabling each latch within address latch circuit 241 and data latch circuit 242 through enable lines 250–253. As each latch is enabled, data is transferred over bus 275 to controller link circuit 205. Because interference can result from scanner transmit signals being improperly received by scanner input driver circuit 245 due to long cable capacitive coupling, address decoder data valid line 258 from address latch circuit 241 cooperates with circuitry in scanner input driver circuit 245 to provide a unique system for avoiding this interference.

Figure 19:
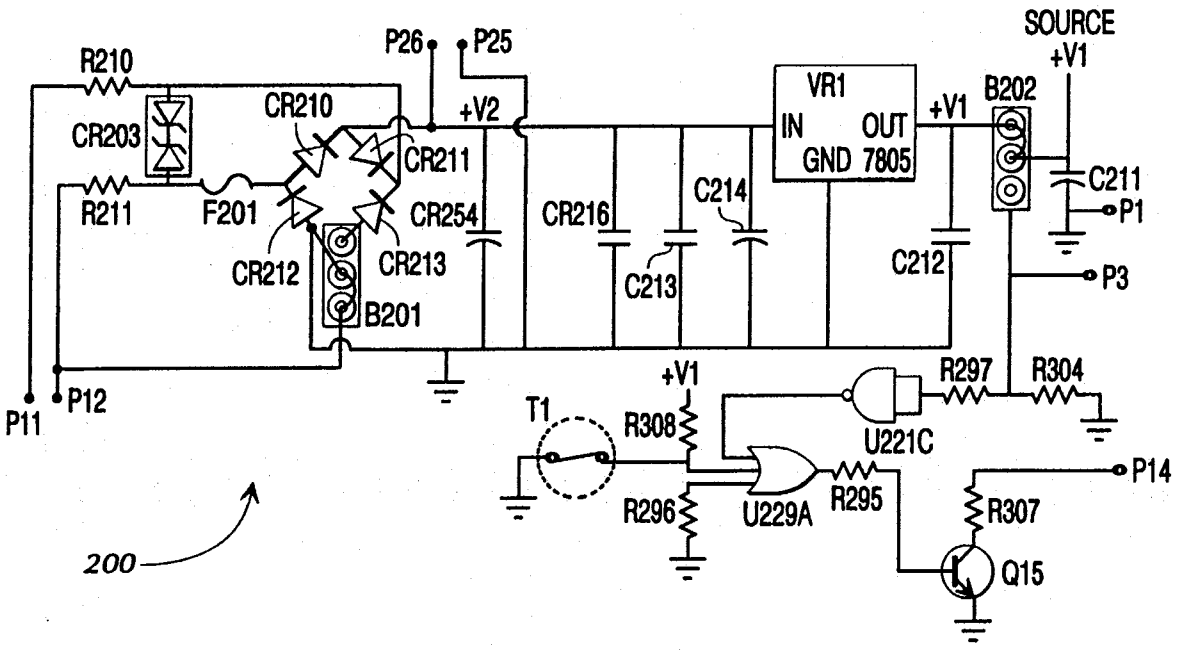
FIG. 19 is a schematic representation of the scanner power supply circuit shown in FIG. 3.

FIG. 19 is schematic representation of scanner power supply circuit 200 seen in block form in FIG. 3. With a few exceptions, scanner power supply circuit functions similarly to receiver power supply circuit 165 shown in FIG. 18. The first additional option is for using the +V1 and ground in controller 19 through lines P1 and P3 instead of using +V1 converted from externally supplied +V2. Line P1 is seen connected to the ground line in FIG. 19. Line P3 can be connected to the +V1 source through jumper B202. Jumper B202 provides the option of using +V1 output from VR1 or from P3. This option is very beneficial widen +V1 is available from controller 19 because of the stability and size of the +V1 source in controller 19. Ground line P25 and +V2 power sample line P26 are seen connected to ground and +V2, respectively. As discussed above, these lines are connected to controller 19. +V2 power sample line P26 provides an indication to controller 19 that +V2 power is continuously being provided to the system. Verification of +V1 power is realized through link P14 which is connected to power check 21, shown in FIG. 1. Resistors R304, R297, NAND gate U221C, OR gate U229A, resistor R295, transistor Q15, and resistor R307 form a circuit which detects a low on P3 and/or the +V1 source and provides a corresponding low on P14. Also, thermal switch T1 and resistor R308 provide notification of scanner overheating to link P14. Resistor 296 simply ties the remaining lead of OR gate U229A low. Through link P14, power failures and overheating may be sensed, and an audio/visual device may be employed in power check 21 to notify appropriate personnel.

Figure 20:
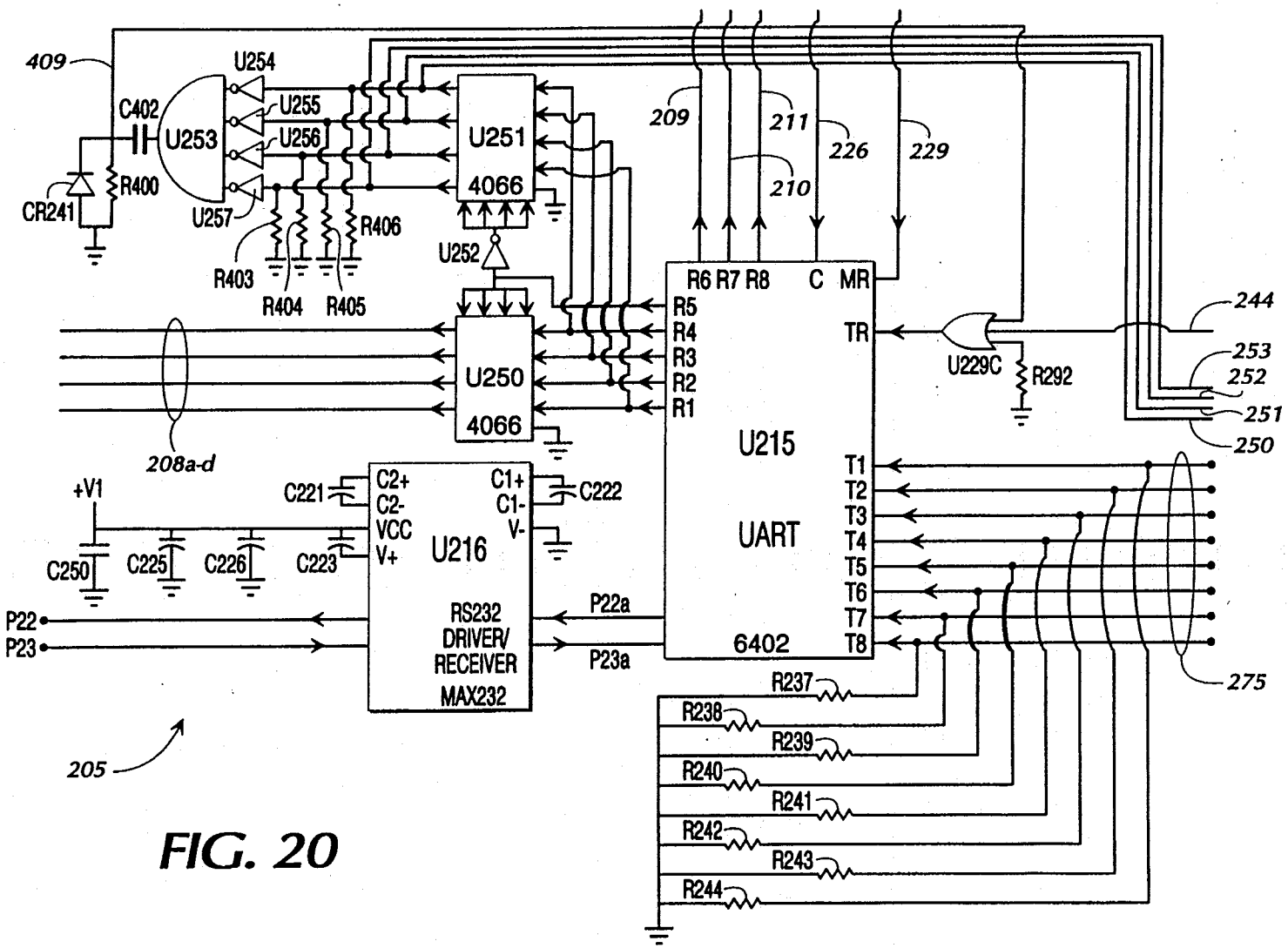
FIG. 20 is a schematic representation of the computer link circuit shown in FIG. 3.

FIG. 20 is a schematic representation of controller link circuit 205 shown in block form in FIG. 3. RS-232 driver/receiver U216 is seen connected to capacitors C221–C223, C225, C226, and C250. These capacitors cooperate with RS-232 driver/receiver U216 to translate signals between controller 19 and UART U215. Signals from controller 19 are received on scanner receive line P23 as RS-232 signals which may range from −10 V to +10 V and are converted to signals ranging between 0 V & +V1 on receive line P23*a* which is connected to an input lead of UART U215. Conversely, signals from UART U215 are sent through transmit line P22*a* to RS-232 driver/receiver U216 which converts them to RS-232 signals on scanner transmit line P22. UART U215 is connected to pull-down resistors R237–R244 which pull data bus 275 down during steady state.

UART U215 outputs signals to other parts of scanner 11 through output leads R1–R8. Signals are received from other parts of scanner 11 through clock input C, reset input MR, transmit control input TR, and bus inputs T1–T8. Output leads R1–R4 are connected through transmission gates U250 and U25 to receiver command lines 208*a–d* which are connected to address generator circuit 216, and to enable lines 253–250 which enable latches in bus circuit 240. Output lead R5 is used as a toggle to enable either transmission gate U250 or U251. With R5 high, transmission gate U250 allows commands to be sent to address generator circuit 216. With R5 low, transmission gate U251 passes signals on leads R1–R4 to enable lines 250–253. Pull-down resistors R403–R406, inverters U254–U257, AND gate U253, capacitor C402, resistor 400, and diode CR 241 are used to sense the falling edge of any enable pulse on enable lines 250–253. Capacitor C402 is normally charged. The outputs of transmission gate U251 are normally low due to pull-down resistors R403–R406 and are inverted before AND gate U253, thus the output of AND gate U253 is normally high. Resistor 400 normally pulls line 409 low. Where a signal is received on any of leads R1–R5, the rise of that signal removes the charge from capacitor C402. The falling edge of the signal then passes through as a rising pulse on line 409 which is connected through OR gate U229C to transmit control input TR which instructs UART U215 to transmit on link P22*a* the condition of bus inputs T1–T8.

Output lead R6 is connected to address counter reset line 209; output lead R7 is connected to address counter increment line 210; and output lead R8 is connected to manual send data line 211. The function of each of these lines is discussed in detail below.

Clock input C is connected to baud rate line 226 which provides the clock pulse for communication with controller 19. Reset input MR is connected to scanner initial reset line 229 which resets UART U215 during the power-up of scanner 11. Transmit control input TR, as discussed above, is connected to OR gate U229C which is connected to output lead R5 to control the transmission on link P22A. OR gate U229C is also connected to data flag output line 244 which provides notification that data from a receiver 12 has been received. Resistor 292 simply grounds the spare lead of OR gate U229C.

Figure 21:
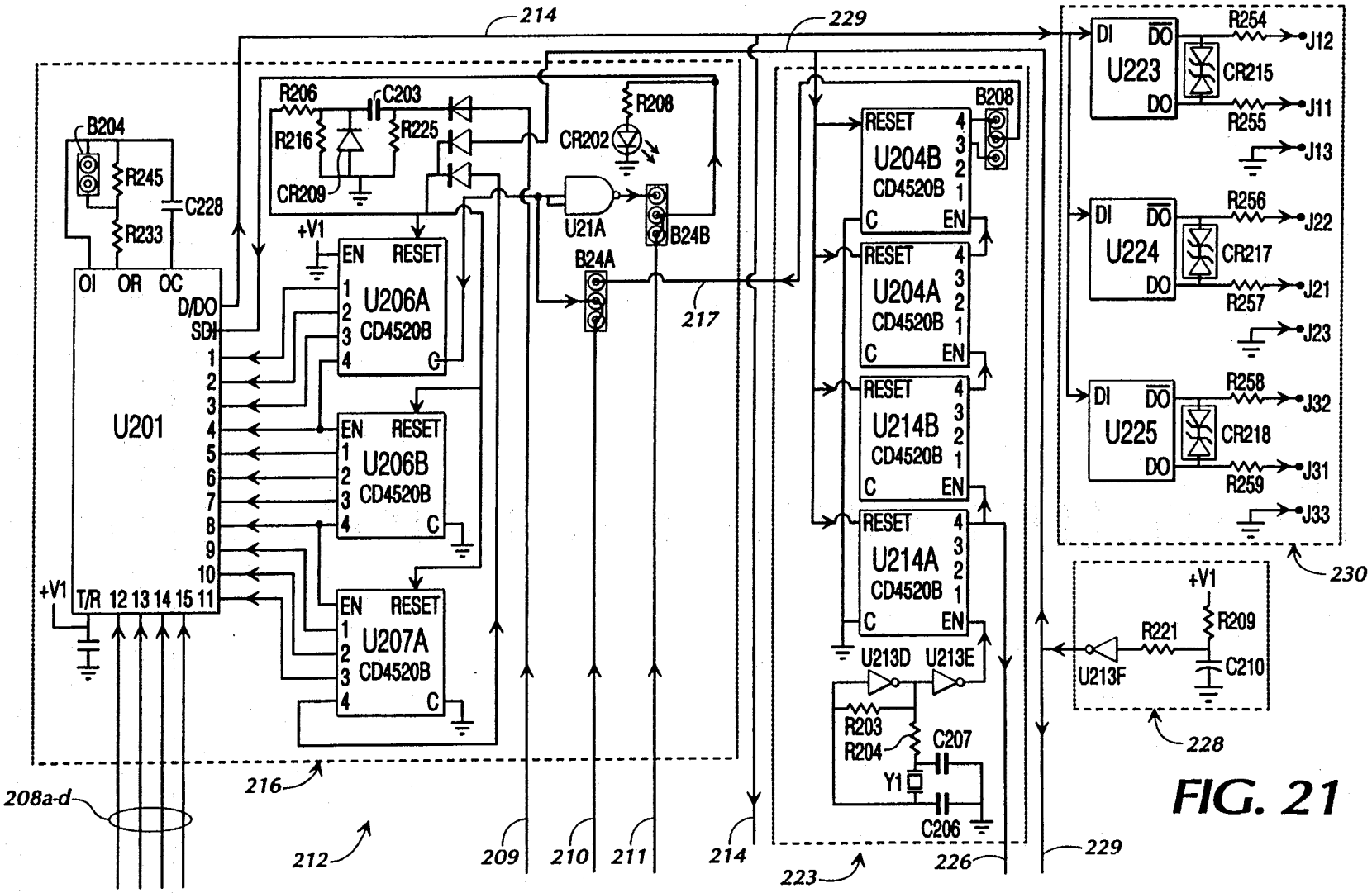
FIG. 21 is a schematic representation of the address generator circuit shown in FIG. 3.

FIG. 21 is a schematic representation of address generator circuit 212 shown in block form in FIG. 3. The circuits represented as blocks in FIG. 3 are delineated by dotted lines in FIG. 21. Initial reset circuit 228 is seen including resistors R209 and R221, capacitor 210 and inverter U213F. As power is turned on, capacitor C210 provides a momentary low to inverter U213F, which in turn provides a momentary high to scanner initial reset line 229. Scanner initial reset line 229 is connected to reset inputs of counter segments U204B, U204A, U214B, and U214A; through diode CR207 to reset inputs of counter segments U206A, U206B, and U207A; and to UART U215 as previously discussed.

Clock circuit 223 is seem including crystal Y1 connected in an oscillator circuit consisting of capacitors C206 & 207, resistors 203 & 204, and inverters U213D and U213E. This oscillator circuit supplies steady pulses to counter segments U214A, U214B, U204A, and U204B. Baud rate line 226 is seen connected to input 4 of counter segment U214A and proceeding towards UART U215 as discussed above with reference to FIG. 3. 9600 baud is an example of one acceptable baud rate. Free run control line 217 is seen connected from input 3 or 4 of counter segment U204B, through jumper B208, to jumper B24A, discussed in detail below. One acceptable example of this pulse rate is 37.5 Hz.

Scanner output driver circuit 230 is seen connected to address generator circuit 216 through encoder output line 214. Output drivers U223, U224, and U225 all receive encoded address signals simultaneously and drive those signals over the connected transmit lines. Balanced system output signals are driven through resistors R254–R259. TVS's CR215, CR217, & CR218 are used to guard against the harmful effects of high energy transients, such as lightning.

Address generator circuit 216 is seen containing address counter composed of counter segments U206A, U206B, and U207A; encoder U201; and related circuitry. Address generator circuit 216 is capable of operating in at least two modes determined by jumpers B24A and B24B: a normal operating mode, and a free run mode. In the normal operating mode, the mode shown in FIG. 21, counter segments U206A, U206B, and U207A and encoder U201 are controlled directly by controller 19 over address counter reset line 209, address counter increment line 210, and manual send data line 211. Encoder U201 transmits encoded data over encoder output line 214 from its D/DO output at the rate determined by the RC network connected to its O1, OR, and OC inputs. Upon receiving a signal on its SDI input, which is connected to jumper B24B, encoder U201 transmits the encoded data corresponding to the state of its inputs 1–15 which are connected to counter segments U206A, U206B, and U207A and receiver command lines 208*a–d*. A signal on the C input of counter segment U206A causes counter segments U206A, U206B, and U207A to increment to the next address.

In the normal operating mode, a signal from controller 19 on address counter increment line 210 causes counter segments U206A, U206B, and U207A to increment to the next address. A signal from controller 19 on manual send data line 211 causes encoder U201 to transmit encoded address data over encoder output line 214. This signal also causes light emitting diode CR202 to provide visual indication of this signal. In the free run mode, the rise of each pulse from clock circuit 223 on free control line 217 increments counter segments U206A, U206B, and U207A, and the fall of the same pulse travels through NAND gate U21A and jumper B24B to cause encoder U201 to transmit the encoded address data. This free run mode is normally used in testing to sequentially poll every possible address.

Address generator circuit 216 also provides for several reset options. All of the reset inputs of counter segments U206A, U206B, and U207A are connected to a wired-OR at diodes CR207 and CR208 and connected to an AC-coupling network composed of R206, R216, diode CR209, capacitor C206, resistor R225, and diode CR206. A high signal on any of address counter reset line 209, scanner initial reset line 229, or output 4 of counter segment U207A resets counter segments U206A, U206B and U207A. The AC-couple network prevents a reset signal from controller 19 over address counter reset line 209 from remaining high for too long. Output 4 of counter segment U207A provides an automatic reset at the highest useable address if for some reason, an address reset signal had not yet been received from controller 19.

Jumper B204, and similarly situated jumpers throughout the system, affect the pulsing rate of the generated data signals. If jumper B204 is configured to provide a short circuit across R245, the pulsing rate is increased. Jumper B204 and its equivalents are designed to cooperate with jumper B208 in clock circuit 223 to accommodate different cable-length environments. Where very long cable is used, signal integrity can suffer; however, if the speed of the data pulses is slowed, integrity can be improved. It is important to note, however, that in order to slow the speed of the data pulses, the polling rate must also be slowed to allow adequate time for each receiver to respond in the free run mode. Jumper B208 is shown using the slower polling rate from output lead 4 of counter segment U204B. By including resistor R245 in the RC circuit connected to address encoder U201, the slower data pulse speed is selected. With regard to other jumpers in similar circuital arrangements throughout the FIGS., the same option must be chosen, or a breakdown in communication could occur.

Figure 22:
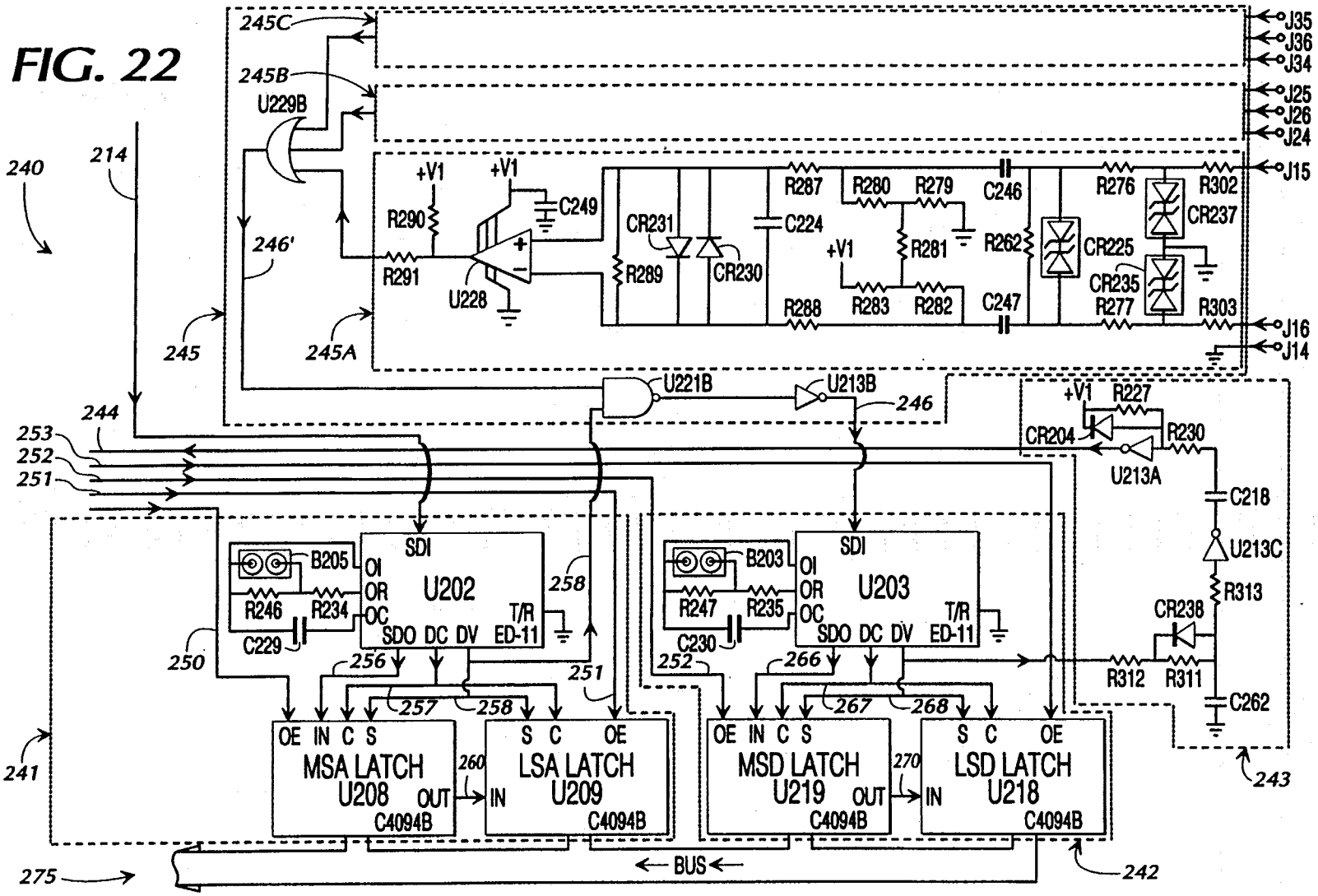
FIG. 22 is a schematic representation of the bus circuit shown in FIG. 3.

FIG. 22 is a schematic representation of bus circuit 240 represented in block diagram in FIG. 3. Scanner input driver 245, address latch circuit 241, data latch circuit 242, and data flag circuit 243 are delineated by dotted lines. Encoded address signals on encoder output line 214 are decoded by address decoder U202 according to the rate determined by resistors R234 and R246, capacitor C229, and jumper B205. Encoded data is received on the SDI input of address encoder U202 and transmitted on the SDO output to MSA latch U208. MSA latch U208 communicates a specified first portion of this data to LSA latch U209 through the MSA out, into the LSA in, over MSA serial transfer line 260. MSA latch U208 DC and DV outputs provide the clock and strobe inputs, C and S, for both MSA latch U208 and LSA latch U209. The data signals received by MSA latch U208 and LSA latch U209 are latched for future transmission on bus 275. This transmission is accomplished when a signal is received on each latch's output enable, OE, input through MSA enable line 250 or LSA enable line 251. When not enabled, the outputs are open circuit disconnected.

Encoded receiver data is received through scanner input driver circuit 245 and supplied to data latch circuit 242 over scanner input driver output line 246. Each of scanner input driver circuits 245A, 245B, & 245C is identical and supplies the received signal to OR gate U229B. Scanner input driver circuit **245*a* receives receiver data packets through lines J15 and J16. These balanced signals are purified by input driver circuit 245*a* to provide clean signals on scanner input driver output line 246. Op-amp U228 is normally biased to amplify the differences in voltage between its + and − terminals. Diodes CR231 an CR230 clamp the input voltage to improve response time after receiving strong signals. Depending on the length of communication link 18**, capacitors C246 and C247, along with the resistor network of R279–283, may be included to remove the DC level from both inputs and then re-supply the bias necessary for correct operation of op-amp U228.

Data latch circuit 242 decodes and latches the data from scanner input driver circuit 245 in much the same way as address latch circuit 241 decodes and latches data from encoder output line 214. When data is received, a signal is provided to data flag circuit 243. Data flag circuit 243 first filters the data through a network similar to that shown in FIG. 9 in receiver 12. The resulting signal from inverter U213C is then channeled through an AC-coupling network of resistors R230 and R227, diode CR204, and inverter U213A to reduce the duration of signals which are too lengthy. A momentary version of the signal is supplied to data flag output line 244 which is connected to UART U215, shown in FIG. 20. This signal indicates to controller 19 that new data has been received from receiver 12. Because interference can result from scanner transmit signals being improperly received by scanner input driver circuit 245 due to long cable capacitive coupling and the very high power of the output lines located near the sensitive input lines, address decoder data valid line 258 from address latch circuit 241 is connected to NAND gate U221B and inverter U213B to block any encoded address signals which might interfere with scanner input driver circuit 245. This signal blocking design alleviates the need to employ balancing efforts to avoid this problem and also improves repeater performance. This design is considered unique to the present invention.

CONTROLLER PROGRAM:

Turning next to FIGS. 23–27, high-level flow chart representations of the controller program, the steps taken by controller 19 in conjunction with the novel features described hereinabove will be disclosed. It should be understood that these flow charts represent the steps taken by controller 19 in this preferred embodiment and that other schemes of control could be adopted to construct equivalent embodiments of the present invention. Furthermore, it is also recognized and considered within the scope of the present invention that many functions of both receiver 12 and scanner 11 are amenable to incorporation into micro-processors located within scanner 11 and/or within each receiver 12.

The steps of FIGS. 23–27 are taken by controller 19 under the guidance of the controller program, one acceptable example of which being a software program stored on the hard drive of a personal computer. In this preferred embodiment, the controller program has access to a database of information corresponding to each receiver 12 and each resident. The controller program guides controller 19 in its control of scanner 11 and the processing of information received from receivers 12 through scanner 11 in conjunction with corresponding information retrieved from the database. Processed data may be stored in a file or output to monitor 26 as text or graphical images or to printer 27.

Figure 23:
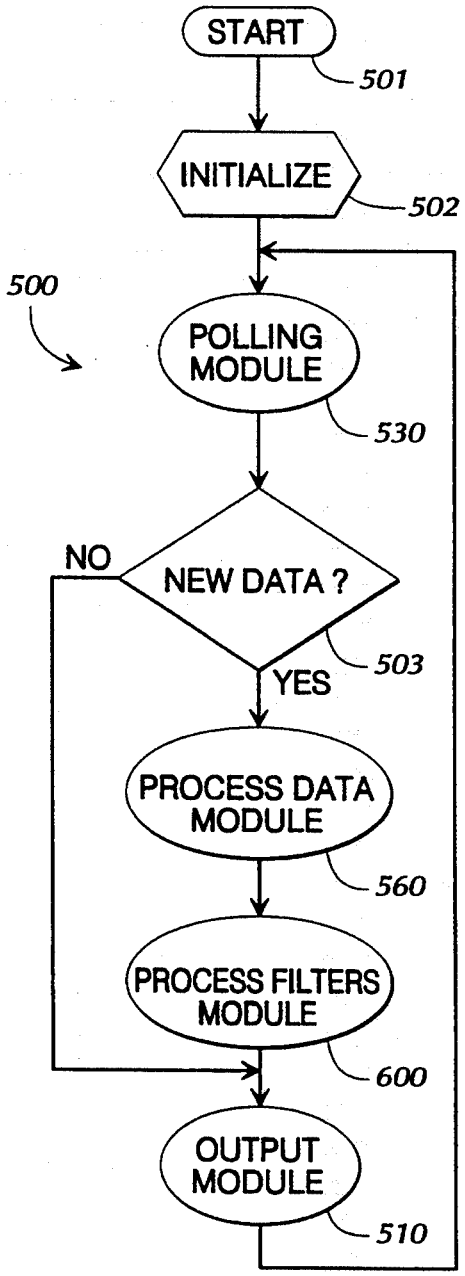
FIG. 23 is a flow chart representation of the executive module of the controller program executed by the controller shown in FIG. 1.

FIG. 23 shows a flow chart representation of the executive module 500 of the controller program. Executive module 500 is seen executing an endless loop after initialize step 502. This loop consists of polling module 530, output module 510, and occasionally process data module 560 and process filters module 600. Initialize step 502 initializes scanner 11, forms various tables by retrieving address information from the database, and defines initial module states. This looping process, along with the state machine architecture of these modules, allows the controller program to simulate concurrent processing. If new data is received during polling module 530, process data module 560 and process filters module 600 are called by executive module 500.

Figure 24:
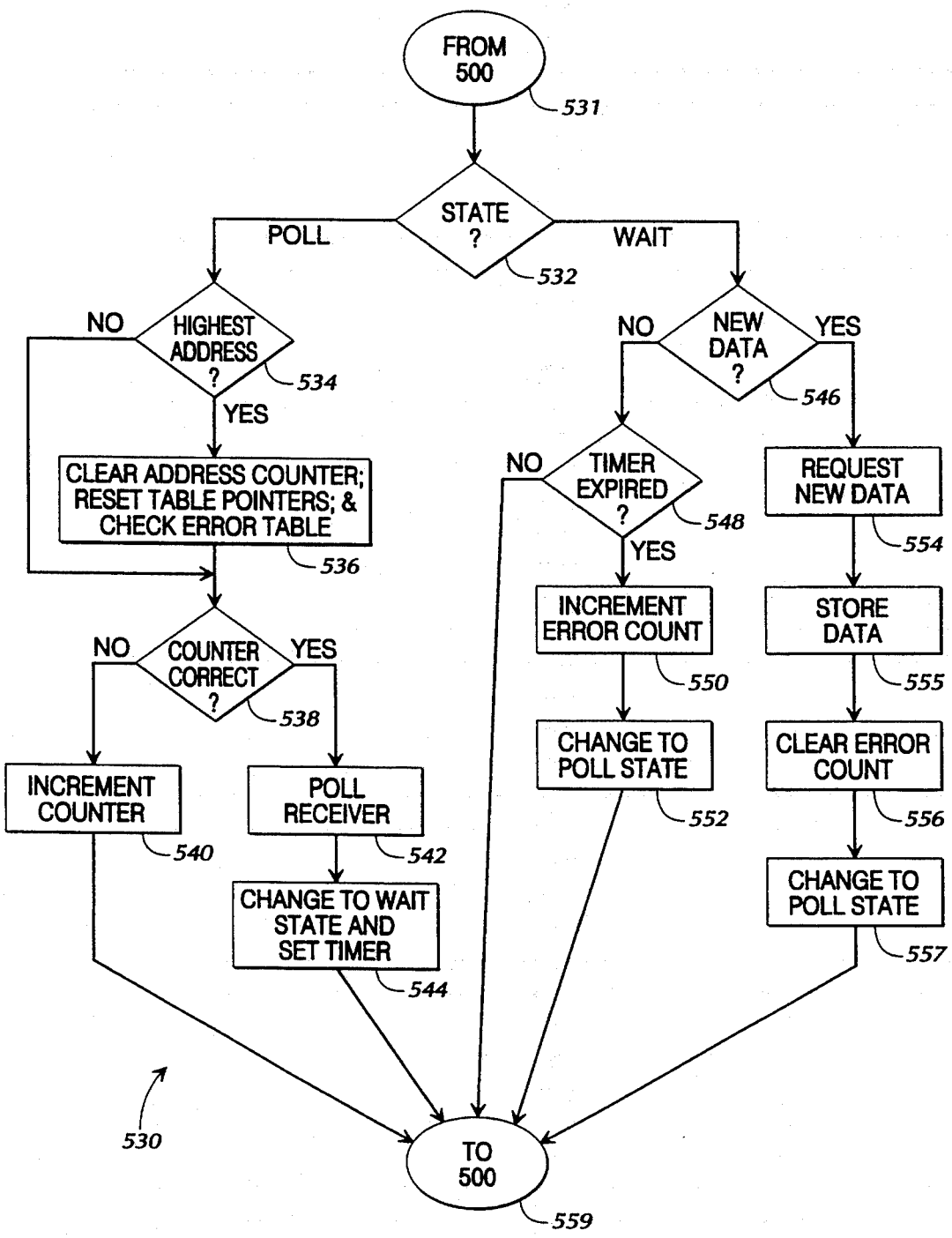
FIG. 24 is a flow chart representation of the polling module shown in FIG. 23.
Figure 25:
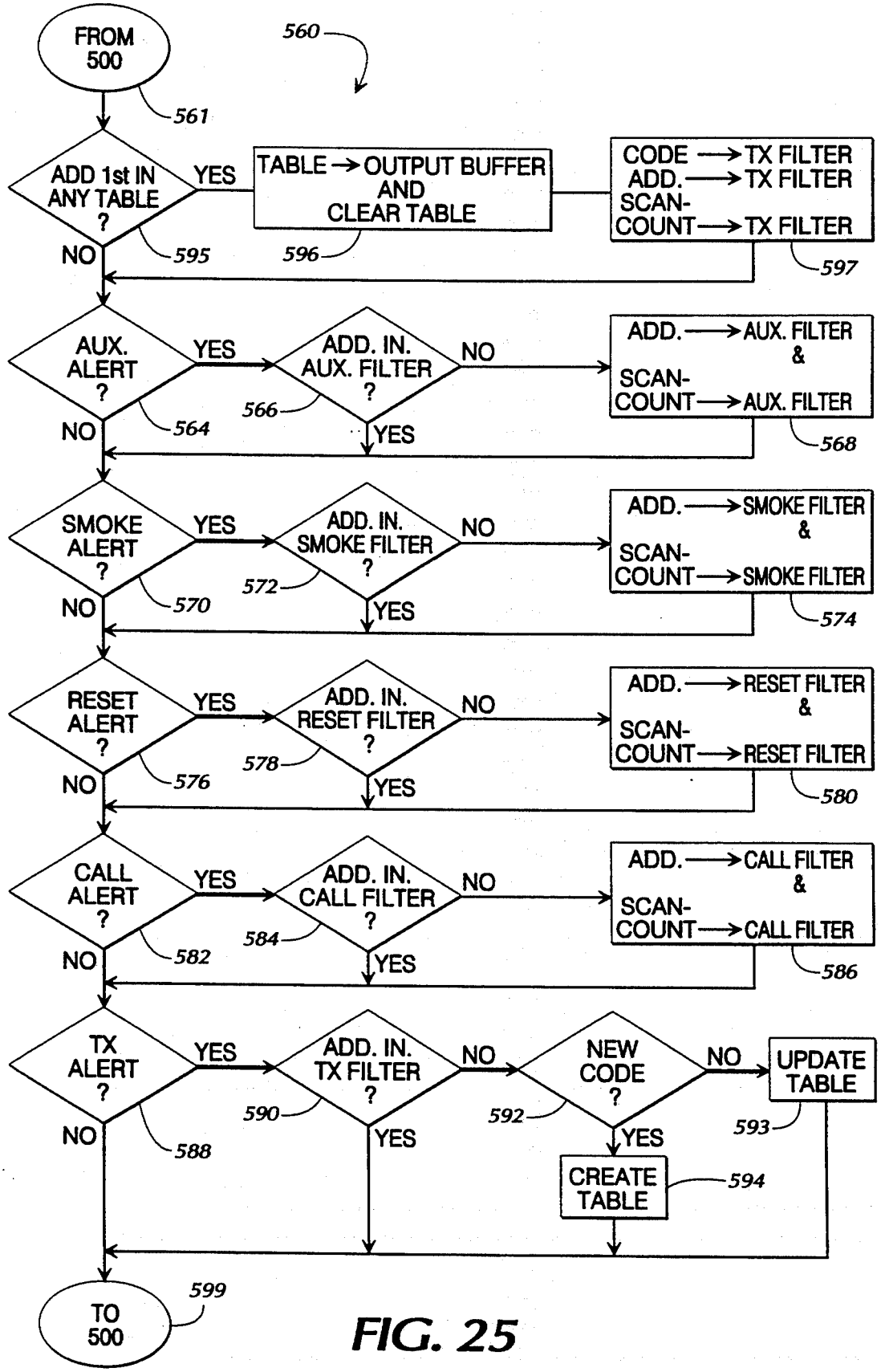
FIG. 25 is a flow chart representation of the process data module shown in FIG. 23.

After initialize step 502, executive module 500 calls polling module 530, shown in detail in FIG. 24. Step 531 indicates the point at which polling module 530 receives control from executive module 500. The next step taken by controller 19 is decision block 532 which inquires about the current state. The initial state is POLL, which directs program flow to decision block 534. Decision block 534 examines an address table formed by initialize step 502 which lists all of the active addresses received from the database during initialization. If the table pointer is referencing the highest address in the table, the address counter in scanner 11 must be reset since addresses are generated in sequence. This resetting is indicated by step 536. Another table formed by initialize step 502 is called the error table. If a receiver 12 does not respond to a polling by scanner 11, an error count associated with that receiver 12 is incremented. Step 536 indicates resetting the pointers in both the address table and the error table. Furthermore, step 536 indicates an inquiry into whether any of the error counts have exceeded a predefined number, at which time an error message would be generated referencing the faulty receiver 12.

The next step taken by polling module 530, regardless of the current address, is decision block 538 which inquires into the validity of the current state of the address counter in scanner 11. A program counter is maintained by module 530 which parallels the current address on the address counter in scanner 11; this program counter is incremented and reset in parallel with the address counter in scanner 11. If this program counter indicates that the address counter in scanner 11 is not currently set to access the appropriate receiver 12, the NO branch of decision block 538 is taken to the increment counter step 540. This step involves sending a signal to scanner 11 instructing it to increment the address counter. Control is then returned to executive module 500 through step 559. Alternately, if the counter is correct, the YES branch of decision block 538 is taken to step 542. The counter may be correct by virtue of it referencing the next receiver 12 in the address table or because additional commands need to be sent to the last polled receiver 12. Step 542 references sending a signal to scanner 11 instructing it to poll the currently addressed receiver 12. Commands for receiver 12 may also accompany this instruction to poll. After step 542, step 544 indicates changing the state of polling module 530 to the WAIT state and the setting of a timer. Control is then returned to executive 500 through step 559.

Looking again to decision block 532, a WAIT state would direct program flow to decision block 546. This block determines whether new data has been received from scanner 11 by checking an input buffer for the existence of any character received from scanner 11. If receiver 12 has not responded to its polling, no new data would exist, and the NO branch of block 546 would be taken to decision block 548. This block determines whether the timer set in step 544 has expired. If so, the error count for that receiver 12 is incremented, and the state is changed back to POLL. Then, and also as if the timer had not yet expired, control is returned to executive 500 through step 559. Alternately, referring back to decision block 546, if new data has been received at scanner 11, the YES branch is taken to step 542. This step instructs scanner 11 to transmit each packet of information from each latch separately. As this data is received by controller 19, it is stored, as indicated by step 555. Step 556 indicates clearing of the error count associated with this receiver 12, and the state is changed back to POLL in step 557. Then, at step 559, control is again directed back to executive 500.

Referring back to FIG. 23, if new data is received during polling module 530, executive 500 calls process data module 560 and process filters module 600. Process data module 560 is seen in detail in FIG. 25. Process data module 560 receives control at step 561. At point after the data is received, it is split into an address, an RF code, and alert information. The unique locating function of the present invention incorporates all receivers 12 which receive a particular RF code. The addresses of each of the receivers 12 which receive a particular RF code are used to determine the location of the transmission. Because the locating process needs all of the addresses which receive a particular code, the addresses are accumulated in a code table until all of the receivers 12 have been polled. Decision block 595 determines whether a table accumulation process is complete by comparing the current address with the first address in each code table. If this address is equal to the first address, the yes branch is taken to steps 596 and 597. Step 596 puts the entire table into an output buffer and then clears the table. Step 597 enters the RF code, the receiver address, and the scan-count into a transmitter ("TX") filter.

The alert information is then examined to determine which alert(s) has occurred. This examination may simply be checking a particular bit in the alert information alone, checking a bit along with the existence or recent receipt of an RF code, or checking the existence of a combination of bits. The first examination is represented as decision block 564 which checks for the existence of an auxiliary alert. The other examination include checking for smoke alert in decision block 570, reset alert in decision block 576, call alert in decision block 582, and transmitter alert in decision block 588. The number of examinations is a function of the number of conditions which are monitored by receivers 12 and should not be considered limited by the number seen in FIG. 25.

Because instructions similar to those for an auxiliary alert for smoke, reset, and call alerts are shown, a description of decision block 566 and step 568 is considered applicable to those alerts unless otherwise noted. In this preferred embodiment, noise filtering is improved through scanner 11 normally receiving at least two samples of an alert signal from receiver 12, as is discussed above with reference to the two-count clear function. Only one of every two samples received by controller 19 is output. As is discussed above, this number may vary depending on the inherent reliability of each particular alert. This function is accomplished through maintaining filters corresponding to each type of alert. Decision block 566 checks whether the address of the current alert is in the auxiliary filter. If the address is not in the filter, the NO branch of decision block 566 is taken to steps 568. This step places the receiver address and a scan-count into the filter. The scan-count, initially set to two (2) as an acceptable example in this preferred embodiment, represents the number of times notice of the same event may be received. Then, as if the address was already in the filter or if there was no auxiliary alert, decision block 570 receives control to test for the next alert.

This process continues with other alerts until decision block 588 is reached. If a TX alert exists, the YES branch is taken to decision block 590 which checks the TX filter, which contains addresses, RF codes, and scan-counts for the particular RF codes which have been received. If the code is not in the filter, the NO branch is taken to decision block 592. Decision block 592 determines whether a table has already been created for the present code or whether one should now be created to accumulate addresses. Depending on the result, step 593 will update an existing table by adding the address of the receiver 12 which received the transmission or step 594 will create a new code table with this address as the first entry. At step 599, control is returned to executive module 500, seen in FIG. 23.

Figure 26:
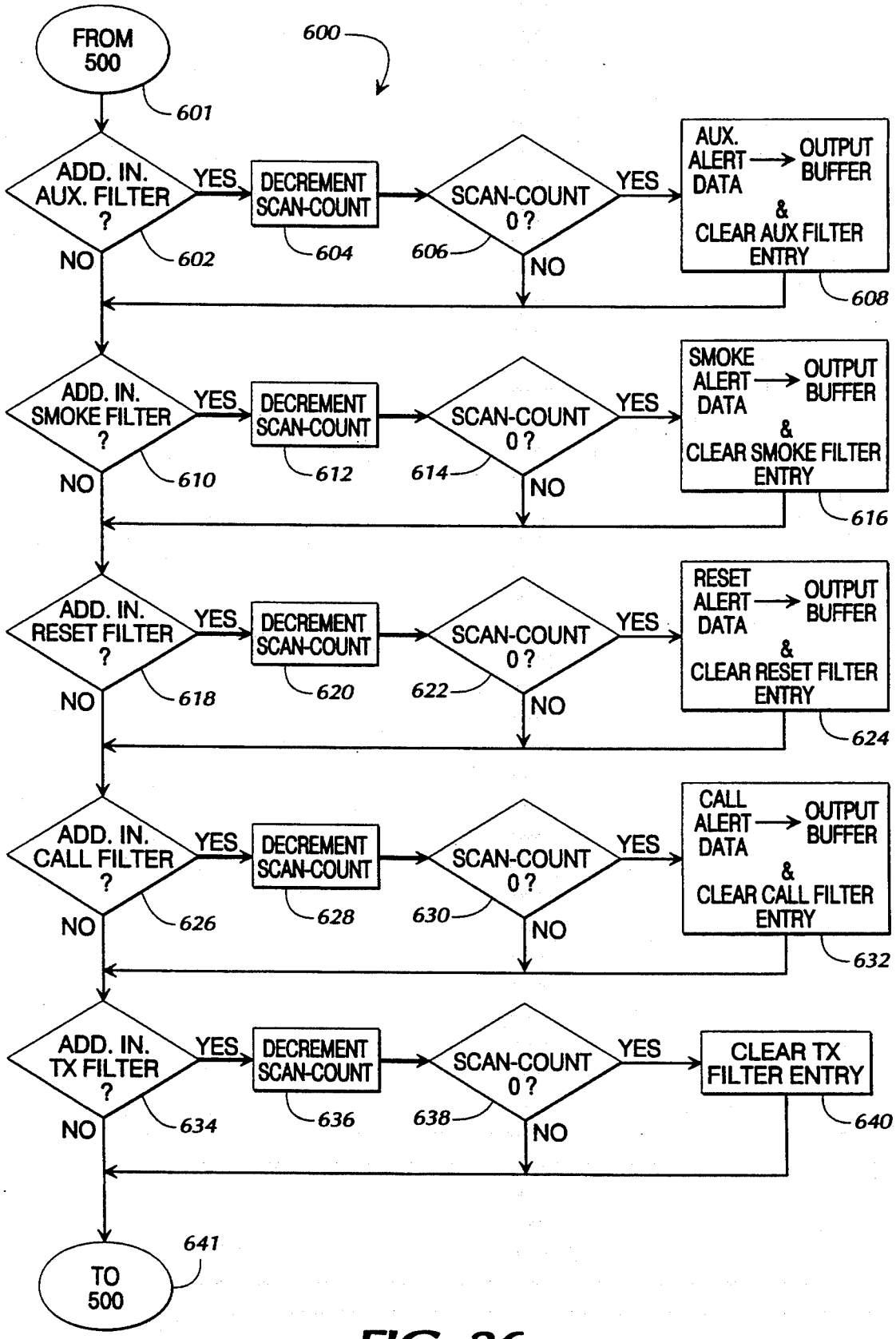
FIG. 26 is a flow chart representation of the process filters module shown in FIG. 23.

Executive module 500 then calls process filters module 600, seen in detail in FIG. 26. Process filters module 600 receives control from executive module 500 at step 601. As in process data module 560, seen FIG. 25, very similar steps are executed for each alarm type; therefore, the steps executed for an auxiliary alert will be considered applicable to the other alerts unless otherwise noted. At decision block 602, the auxiliary filter is tested for the existence of the current receiver address. This test is independent of whether an auxiliary alarm has occurred during this pass through process filters module 600. If the address is in the auxiliary filter, the YES branch is taken to step 604 which decrements the corresponding scan-count. If the scan-count is then equal to 0, the YES branch of decision block 606 is taken to step 608. This step is executed when two auxiliary alerts have been received from the same receiver, reducing the chance that the first was noise. The auxiliary alert data is copied into the output buffer, and the auxiliary filter is cleared of the entry corresponding to this address. Then, as if the scan-count were not equal to zero or the address were not in the auxiliary filter, control is directed to decision block 610, and a similar process continues.

It is important to note that some alerts, like the reset alert which may be used to indicate daily check, do not need to be output to the screen or printer. These type alerts are simply written to a file, as indicated by step 624. Also, because the TX alert table is placed in the output buffer in process data module 560, seen in FIG. 25, step 640 simply clears the TX filter entry. Control is finally returned to executive module 500 at step 641.

Figure 27:
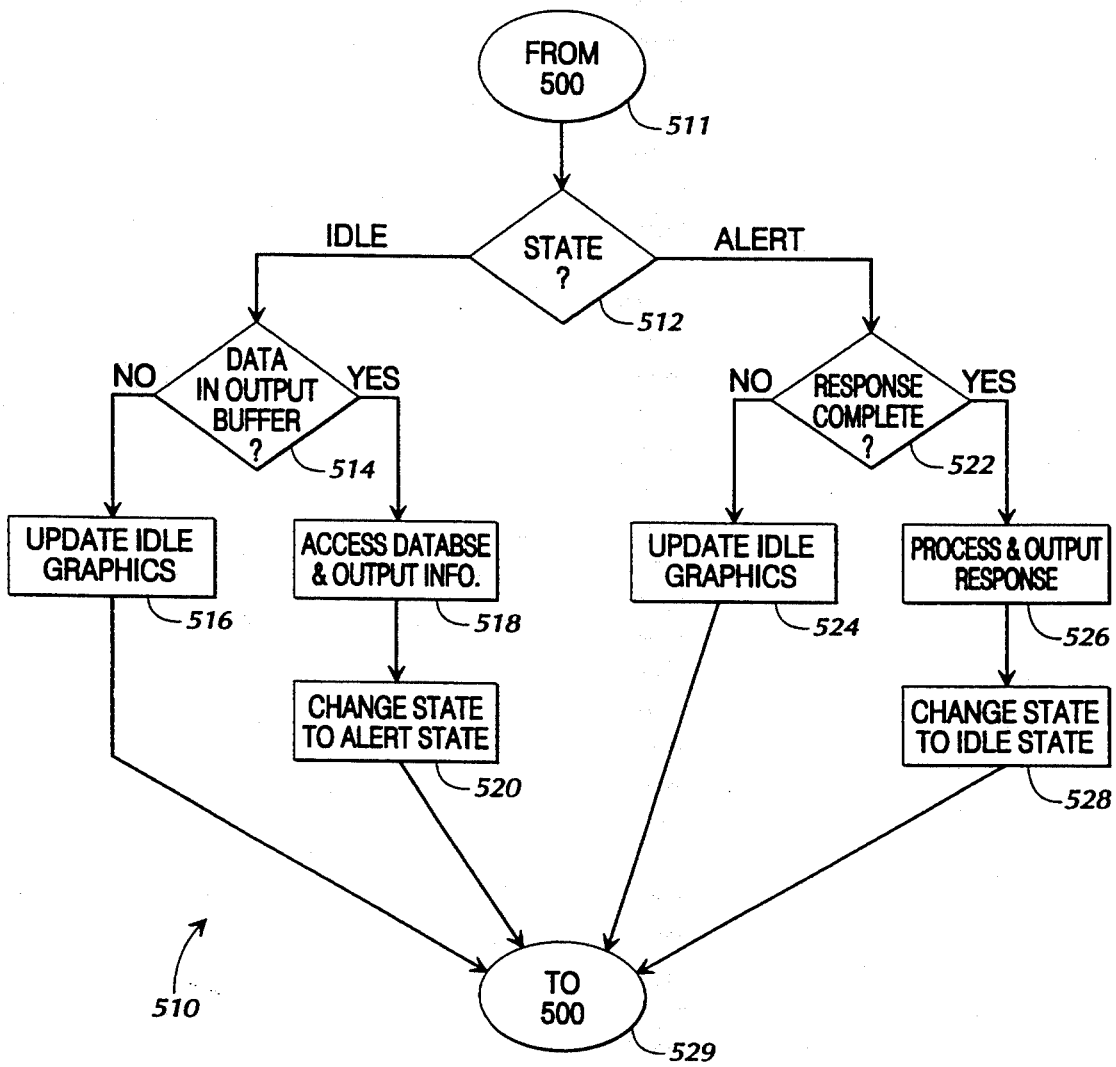
FIG. 27 is a flow chart representation of the output module shown in FIG. 23.

FIG. 23 shows that executive module 500 then calls output module 510, seen in detail in FIG. 27. Output module 510 receives control at step 511. Decision block 512 then determines the state of output module 510. The initial state of output module 510 is IDLE; therefore, the IDLE branch is taken to decision block 514. If no data has been placed in the output buffer, the NO branch is taken to step 516 which updates the idle graphics on monitor 26 of controller 19. Control is then returned to executive module 500 through step 529.

Alternately, if data has been placed in the output buffer, the database is accessed for information corresponding to the receiver address and other information relating to the person assigned to that receiver 12, such as medical or emergency information. Also, if a transmitter alert has been detected, the addresses are first checked against the address which is assigned to the RF code which was received. If so, it is assumed that the resident is transmitting from his/her own room. If there is no match, it is not assumed that the resident is in his/her room; therefore, a locating method which utilizes a three-dimensional coordinate system is begun to determine the address of the receiver which is nearest the personal transmitter 15 which transmitted the particular code in question. The database is accessed for each one of the addresses received from the output buffer. Each address corresponds to a receiver that is assigned a position in space relative to a bottom corner origin of a high rise building. X, Y & Z coordinates in feet from the origin have previously been assigned to each receiver record as separate fields of information. The X & Y coordinates correspond to horizontal distances in feet from the origin, and the Z coordinate corresponds to the vertical distances in feet from the origin. Each of the Z coordinates are first averaged together to determine from which floor of the building personal transmitter 15 is most likely transmitting. The X & Y coordinates are then averaged to determine an average point in the horizontal plane from which the personal transmitter is most likely transmitting. A distance calculation involving averaging is then made between that average point in horizontal space and the X & Y coordinates of every receiver on that particular floor. The receiver on that floor which is closest to the average point is then identified. After the receiver closest to the personal transmitter 15 is identified, information relating to the resident whose code was transmitted as well as information relating to the receiver closest to the personal transmitter 15 is retrieved from the database.

Unlike many locating systems which measure signal strength, the locating system of the present invention depends on the presence or absence of a particular signal from a set of receivers 12. If a code is assigned to one to the receivers 12 which returned the code, the location of transmission is first assumed to be near that particular receiver. Otherwise, the three-dimensional method discussed above is employed. This locating method of the present invention is considered unique.

After all of the information is processed and received from the database, it is output to monitor 26 of controller 19 to graphically identify the type and location of the alert along with other resident information. A user response is normally requested at this point. The state is then changed to ALERT, and control returns to executive module 500 at step 529.

When output module 510 is executed during an ALERT state, the NO branch of decision block 512 is taken to decision block 522. If the requested user response is not complete, the NO branch is taken to update the idle graphics in step 524 and return control to executive module 500 in step 529. If the response is complete, the YES branch is taken to step 526. This step processes the user input and outputs the response. The state is then returned to IDLE in step 528, and control is returned to executive module 500 in step 529.

Whereas the present invention has been described in detail with specific reference to particular embodiments thereof, it will be understood that variations and modifications which will suggest themselves to those skilled in the art can be effected within the spirit and scope of the invention as described hereinbefore and as defined in the appended claims.

I claim:

1. Method of monitoring a plurality of remote conditions from a central location, said method comprising the steps of:

providing a monitoring system which includes a plurality of portable radio transmitters which each selectively emits a radio signal with a unique radio code, a plurality of remotely located receivers for receiving radio signals from any in-range portable radio transmitter of the plurality of radio transmitters, and a centrally located scanner;

receiving at a particular remotely located receiver a radio signal with a radio code from a portable radio transmitter of the plurality of portable radio transmitters;

responding to the receipt of the radio signal by comparing the radio code to a predefined radio code format stored in the remotely located receiver to verify that the radio signal was transmitted from a portable radio transmitter of the plurality of portable radio transmitters and further comparing the radio code to a unique radio code associated with the particular remotely located receiver to verify that the radio signal was transmitted from a particular portable radio transmitter associated with the particular remotely located receiver;

storing the radio code in the particular remotely located receiver upon verifying that the radio signal was transmitted from a portable radio transmitter of the plurality of portable radio transmitters without regard to whether the radio signal was transmitted from the particular portable radio transmitter associated with the particular remotely located receiver;

polling each remotely located receiver from the centrally located scanner for information previously stored in each remotely located receiver; and transmitting information from each remotely located receiver to the centrally located scanner.

2. Method of claim 1, wherein said providing step further includes providing a plurality of remote detectors associated with the plurality of remotely located receivers, and further comprising steps of monitoring a plurality of conditions through the plurality of remote detectors and the plurality of remotely located receivers; and storing at the remotely located receivers representations of changes of conditions detected by the plurality of remote detectors.

3. Method of claim 2, wherein the monitoring step includes monitoring a plurality of conditions through each remotely located receiver, and wherein the transmitting step includes assembling and transmitting a multiple bit receiver signal packet simultaneously representative of radio code information and representations of all changes of conditions detected by each remotely located receiver.

4. Method of claim 1, further comprising a step of, immediately before the polling step, substituting for the radio code in storage the unique radio code associated with the particular remotely located receiver upon receipt of a radio signal with the unique radio code.

5. A monitoring system comprising:

a plurality of detector means for detecting off-normal states of monitored conditions and for producing detector indications of said states;

a plurality of readily portable, personal radio transmitter means for selectively transmitting radio signals with radio codes unique to each radio transmitter means;

a plurality of receiver means associated with said plurality of detector means and said plurality of radio transmitter means for responding to said detector indications and said radio signals, wherein each receiver means of said plurality of receiver means includes, at least, detector monitor means for monitoring said detector indications of at least two detector means of said plurality of detector means, radio monitor means for continuously monitoring radio signals to receive any radio signal from any in-range radio transmitter means of said plurality of radio transmitter means, wherein each radio transmitter means of said plurality of radio transmitter means transmits throughout a range including, depending on receiver means arrangement, at least two receiver means of said plurality of receiver means, format comparison means for, upon receiving a radio signal with a radio code, comparing the radio code to a predefined code format stored in said receiver means to determine if the radio signal was emitted from a radio transmitter means of said plurality of radio transmitter means, assigned code comparison means for, upon receiving a radio signal with a radio code, comparing the radio code to a unique radio code assigned to said receiver means to determine if the radio signal was emitted from a particular radio transmitter means of said plurality of radio transmitter means associated with said receiver means, and packet generation means for generating a multiple bit receiver signal packet simultaneously representative of, at least, all detector indications associated with said receiver means and results of said radio code comparisons; and a scanner means associated with said plurality of receiver means for transmitting to said plurality of receiver means a separate multiple bit address packet for each receiver means of said plurality of receiver means and for receiving said multiple bit receiver signal packets from said plurality of receiver means.

6. Monitoring system of claim 5, wherein at least one detector means of said plurality of detector means comprises a switch means, wherein said detector indication defines a switch movement of said switch means.

7. Monitoring system of claim 5, wherein at least one detector means of said plurality of detector means comprises a resistance means, wherein said detector indication defines a change in resistance of said resistance means.

8. Monitoring system of claim 5, further comprising computer means connected to said scanner means for transmitting control signals to said scanner means to control said scanner means and for receiving scanner output signals corresponding to said scanner address packets and said receiver signal packets, and for storing and processing said scanner output.

9. Monitoring system of claim 5, wherein said scanner means includes means for transmitting said address packets to said plurality of receiver means in any order.

10. Monitoring system of claim 5, wherein each receiver means of said plurality of receiver means further includes detector memory means for, upon detecting a detector indication, storing a representation of said detector indication until said receiver means receives from said scanner means an address packet identifying said receiver means.

11. Monitoring system of claim 5, wherein each receiver means of said plurality of receiver means further includes radio memory means for, upon receiving a radio signal with a radio code from a radio transmitter means of said plurality of radio transmitter means, storing the radio code until said receiver means receives from said scanner means an address packet identifying said receiver means.

12. Monitoring system of claim 5, wherein each receiver means of said plurality of receiver means further includes radio memory means for, upon receiving over time a plurality of radio signals with a plurality of radio codes from at least two of said plurality of radio transmitter means, storing the last radio code received until said receiver means receives from said scanner means an address packet identifying said receiver means.

13. Monitoring system of claim 5, wherein each receiver means of said plurality of receiver means further includes radio memory means for, upon receiving over time a plurality of radio signals with a plurality of radio codes from at least two of said plurality of radio transmitter means, including said particular associated radio receiver transmitting said particular unique radio code, storing the particular unique radio code received until said receiver means receives from said scanner means an address packet identifying said receiver means.

14. Monitoring system of claim 5, wherein said multiple bit receiver signal packet also includes a radio code received in a radio signal from any radio transmitter means of said plurality of radio transmitter means.

* * * * *